US010910720B2

(12) United States Patent
Fukunaga et al.

(10) Patent No.: US 10,910,720 B2
(45) Date of Patent: Feb. 2, 2021

(54) ANTENNA

(71) Applicant: TDK CORPORATION, Tokyo (JP)

(72) Inventors: Tatsuya Fukunaga, Tokyo (JP); Yuichi Kimura, Saitama (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 16/551,169

(22) Filed: Aug. 26, 2019

(65) Prior Publication Data

US 2020/0076083 A1 Mar. 5, 2020

(30) Foreign Application Priority Data

Aug. 30, 2018 (JP) ..... 2018-161911

(51) Int. Cl.

| | |
|---|---|
| ***H01Q 1/38*** | (2006.01) |
| ***H01Q 9/04*** | (2006.01) |
| *H01Q 5/30* | (2015.01) |
| *H01Q 13/10* | (2006.01) |
| *H01Q 21/30* | (2006.01) |

(52) U.S. Cl.

CPC ..... *H01Q 9/0464* (2013.01); *H01Q 1/38* (2013.01); *H01Q 5/30* (2015.01); *H01Q 9/045* (2013.01); *H01Q 9/0414* (2013.01); *H01Q 13/106* (2013.01); *H01Q 21/30* (2013.01)

(58) Field of Classification Search

CPC ..... H01Q 1/38; H01Q 9/0414; H01Q 9/045; H01Q 9/0464; H01Q 13/106; H01Q 21/30

See application file for complete search history.

(56) References Cited

U.S. PATENT DOCUMENTS

| | | | | |
|---|---|---|---|---|
| 6,750,826 | B2 * | 6/2004 | Schultze | H01Q 9/0414 343/767 |
| 8,077,092 | B2 * | 12/2011 | Coupez | H01Q 1/38 343/700 MS |
| 9,673,526 | B1 * | 6/2017 | Jensen | H01Q 9/0414 |
| 9,966,669 | B2 * | 5/2018 | Dobric | H01Q 1/3275 |
| 2007/0052587 | A1 * | 3/2007 | Cheng | H01Q 9/0457 343/700 MS |
| 2007/0268188 | A1 * | 11/2007 | Guha | H01Q 9/0414 343/700 MS |
| 2012/0268347 | A1 * | 10/2012 | Tatarnikov | H01Q 9/0407 343/893 |

FOREIGN PATENT DOCUMENTS

| | | |
|---|---|---|
| JP | 2008-172697 A | 7/2008 |
| WO | 2007/060782 A1 | 5/2007 |

* cited by examiner

*Primary Examiner* — Thuy Vinh Tran
(74) *Attorney, Agent, or Firm* — Oliff PLC

(57) ABSTRACT

An antenna includes a dielectric, first to fourth antenna electrodes, and at least one probe electrode. The dielectric has first to fifth planes stacked parallel to each other in a stacking direction. The first to the fourth antenna electrodes each have an annular shape. The first antenna electrode is disposed on the first plane. The second antenna electrode is different in size from the first antenna electrode and disposed on the second plane. The third antenna electrode is disposed on the third plane. The fourth antenna electrode is different in size from the third antenna electrode and disposed on the fourth plane. The probe electrode is disposed on the fifth plane and overlaps one or both of the first and third antenna electrodes and one or both of the second and fourth antenna electrodes when seen in plan view along the stacking direction.

7 Claims, 32 Drawing Sheets

ENTIRE

1ST MODE (27.6-29.2 GHz)

2ND MODE (37.8-39.5 GHz)

RADIATION PATTERN ON E-PLANE AT 28 GHz

RADIATION PATTERN ON E-PLANE AT 28 GHz

RADIATION PATTERN ON E-PLANE AT 28 GHz

ANTENNA

CROSS REFERENCE TO RELATED APPLICATIONS

This application claims the benefit of Japanese Priority Patent Application No. 2018-161911 filed on Aug. 30, 2018, the entire contents of which are incorporated herein by reference.

BACKGROUND

The disclosure relates to an antenna supporting multiband operations.

With the advancement of technology, there is a growing demand for broadband antennas that enable higher-speed communication, and multiband antennas that simultaneously use multiple frequency bands having different specifications. For example, International Publication No. 2007/060782 and Japanese Unexamined Patent Application Publication No. 2008-172697 disclose a multiband antenna including multiple antenna electrodes disposed on the same plane.

SUMMARY

An antenna according to one embodiment of the disclosure includes: a dielectric, a first antenna electrode, a second antenna electrode, a third antenna electrode, a fourth antenna electrode, and at least one probe electrode. The dielectric has a first plane, a second plane, and a third plane, a fourth plane, and a fifth plane that are stacked parallel to each other in a stacking direction. The third plane is different from the first plane, the fourth plane is different from the second plane, and the fifth plane is different from the first to the fourth planes. The first antenna electrode has an annular shape and is disposed on the first plane. The second antenna electrode has an annular shape and is disposed on the second plane. The second antenna electrode is different in size from the first antenna electrode. The third antenna electrode has an annular shape and is disposed on the third plane. The fourth antenna electrode has an annular shape and is disposed on the fourth plane. The fourth antenna electrode is different in size from the third antenna electrode. The at least one probe electrode is disposed on the fifth plane and overlaps one or both of the first antenna electrode and the third antenna electrode and one or both of the second antenna electrode and the fourth antenna electrode when seen in plan view along the stacking direction. The first to the fourth antenna electrodes are configured to be electrically powered via the at least one probe electrode. The first to the fourth antenna electrodes include the largest antenna electrode having an outer periphery and disposed most outside among the first to the fourth antenna electrodes. The remaining antenna electrodes other than the largest antenna electrode among the first to the fourth antenna electrodes are disposed inward from the outer periphery of the largest antenna electrode when seen in the plan view along the stacking direction.

BRIEF DESCRIPTION OF THE DRAWINGS

The accompanying drawings are included to provide a further understanding of the disclosure and are incorporated in and constitute a part of this specification. The drawings illustrate example embodiments and, together with the specification, serve to explain the principles of the disclosure.

DETAILED DESCRIPTION

Figure 1:
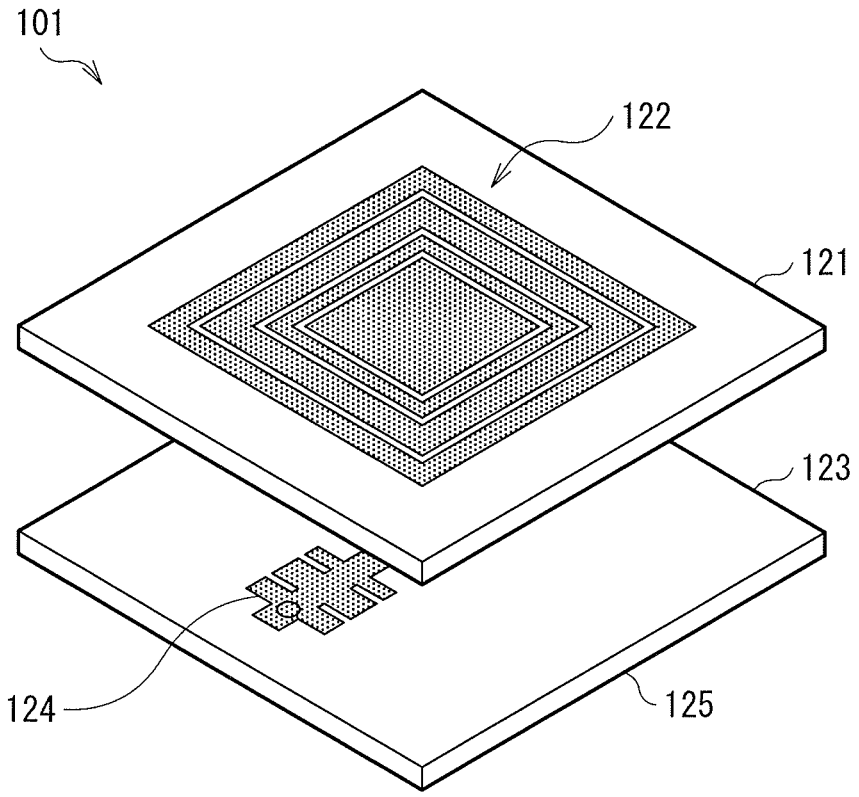
FIG. 1 PRIOR ART
FIG. 1 is a perspective view of an antenna according to a comparative example.

In the following, some example embodiments of the disclosure are described in detail, in the following order, with reference to the accompanying drawings. Note that the following description is directed to illustrative examples of the disclosure and not to be construed as limiting the disclosure. Factors including, without limitation, numerical values, shapes, materials, components, positions of the components, and how the components are coupled to each other are illustrative only and not to be construed as limiting the disclosure. Further, elements in the following example embodiments which are not recited in a most-generic independent claim of the disclosure are optional and may be provided on an as-needed basis. The drawings are schematic and are not intended to be drawn to scale. Note that the like elements are denoted with the same reference numerals, and any redundant description thereof will not be described in detail. Note that the description is given in the following order.

Figure 2:
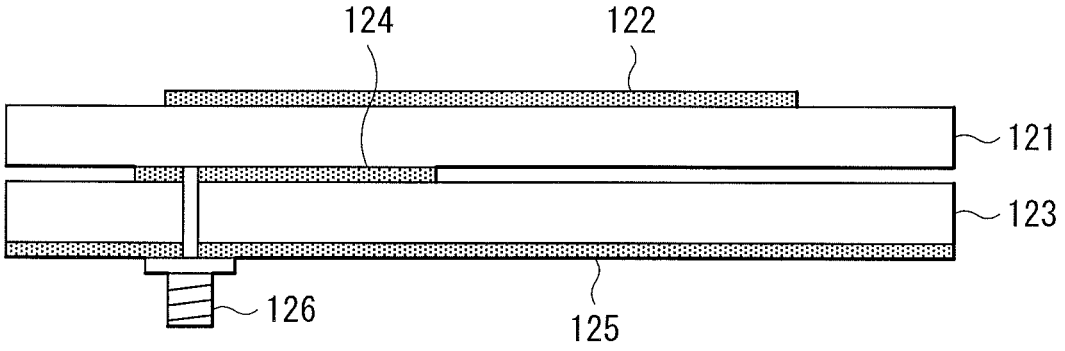
FIG. 2 PRIOR ART
FIG. 2 is a cross-sectional view of the antenna according to the comparative example.
Figure 3:
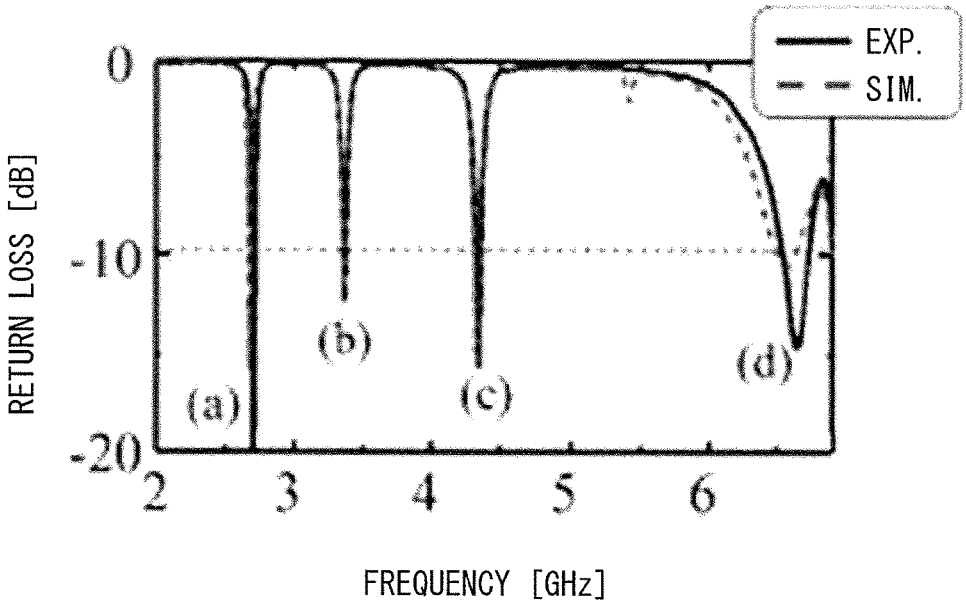
FIG. 3 PRIOR ART
FIG. 3 is a diagram illustrating return loss characteristics of the antenna according to the comparative example.

0. Outline of Comparative Antenna and Exemplary Antenna (FIGS. 1 to 3)

1. First Embodiment (Example Configuration of Antenna Including Antenna Electrode Having Two-Layered Structure: FIGS. 4 to 24)

1.1 Example Configuration of Antenna of First Embodiment (FIGS. 4 to 9)

1.2 Modification Example of First Embodiment (FIGS. 10 to 24)

Figure 25:
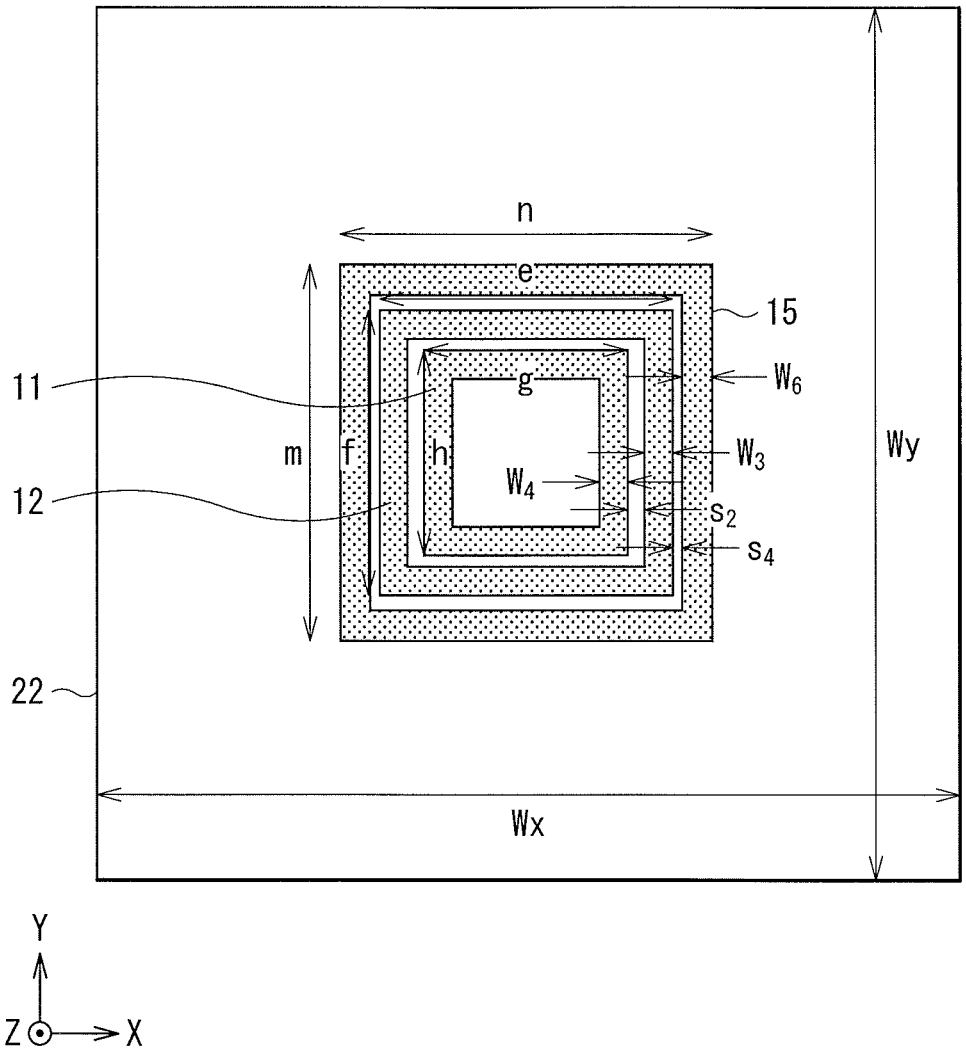
FIG. 25 is a plan view of a second antenna layer of an antenna according to one embodiment.
Figure 26:
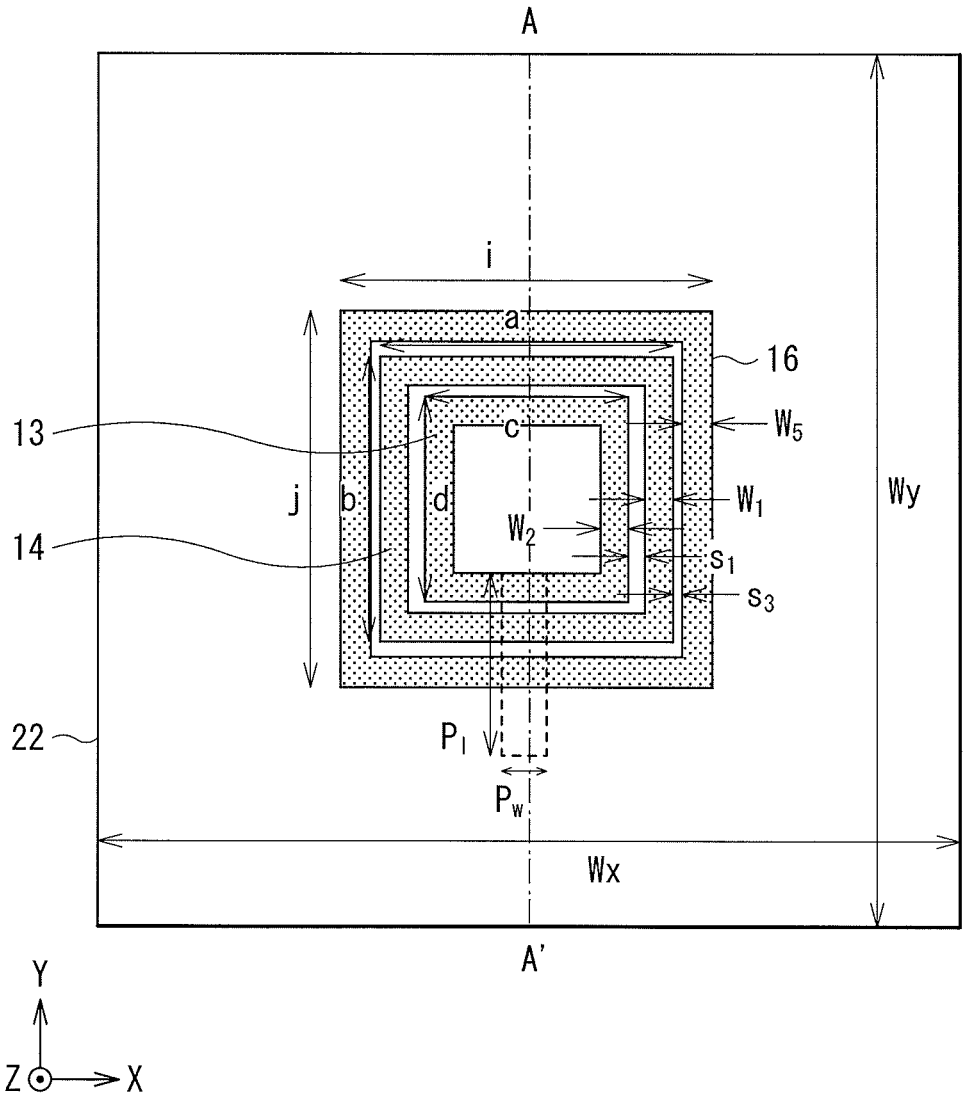
FIG. 26 is a plan view of a first antenna layer of the antenna according to one embodiment.
Figure 27:
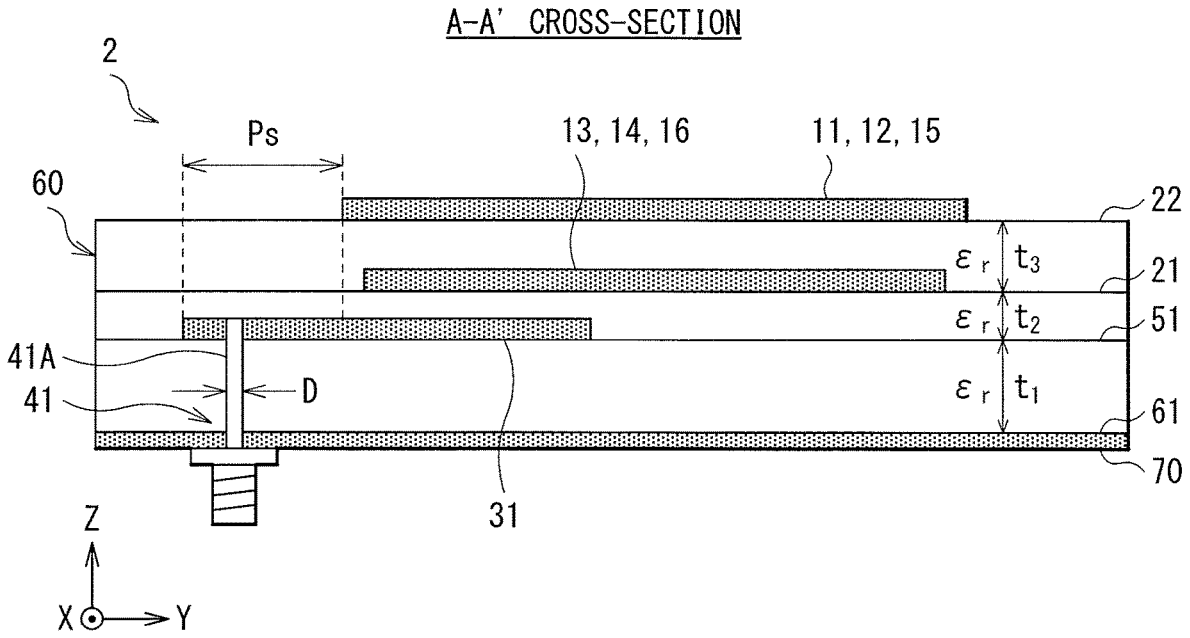
FIG. 27 is a cross-sectional view of the antenna according to one embodiment.

2. Second Embodiment (Example Configuration of Antenna Having Three or More Antenna Electrodes on One Plane: FIGS. 25 to 27)

3. Third Embodiment (Example Configuration of Antenna Including Antenna Electrode Having Three-Layered Structure: FIGS. 28 to 38)

3.1 Example Configuration of Antenna of Third Embodiment 3.2 Modification Example of Third Embodiment 4. Fourth Embodiment (Example Configuration of Antenna Including Antenna Electrode Having Four-Layered Structure: FIGS. 39 to 45)

4.1 Example Configuration of Antenna of Fourth Embodiment 4.2 Modification Example of Fourth Embodiment 5. Other Embodiments

0. OUTLINE OF COMPARATIVE ANTENNA AND EXEMPLARY ANTENNA

It is difficult with a typical antenna that includes multiple antenna electrodes on the same plane to widen respective bandwidths of the antenna electrodes.

It is desirable to provide an antenna with multiple frequency bands each having a wide bandwidth.

FIG. 1 illustrates an example perspective configuration of an antenna 101 according to a comparative example. FIG. 2 illustrates an example cross-sectional configuration of the antenna 101 according to the comparative example.

The antenna 101 according to the comparative example includes a first insulating substrate 121 and a second insulating substrate 123.

The first insulating substrate 121 is provided with an antenna device 122 that includes multiple antenna electrodes disposed on the same plane. The antenna electrodes of the antenna device 122 include annular antenna electrodes and a quadrangular antenna electrodes.

The second insulating substrate 123 is provided with a probe electrode 124 and a ground layer 125. The second insulating substrate 123 is also provided with a power-feed connector 126. A portion of the power-feed connector 126 extends through the second insulating substrate 123 and is coupled to the probe electrode 124. The antenna device 122 is electrically powered via the power-feed connector 126 and the probe electrode 124.

FIG. 3 illustrates return loss characteristics of the antenna 101 according to the comparative example. In FIG. 3, a horizontal axis represents a frequency, and a vertical axis represents a return loss. A solid line in FIG. 3 represents a measured value (Exp.), and a dot line represents a simulation value (Sim.).

When the antenna 101 according to the comparative example is electrically powered via the probe electrode 124, an electric current flows in each of the antenna electrodes disposed on the same plane to cause each of the antenna electrodes to occur specific resonance based on the current path. First to fourth resonance modes are generated in the antenna 101. The first resonance mode is based on the longest one of the current paths of the antenna electrodes, the second resonance mode is based on the second longest one of the current paths of the antenna electrodes, the third resonance mode is based on the third longest one of the current paths of the antenna electrodes, and the fourth resonance mode is based on the shortest one of the current paths of the antenna electrodes. In FIG. 3, the characteristic in the first resonance mode is represented by (a), the characteristic in the second resonance mode is represented by (b), the characteristic in the third resonance mode is represented by (c), and the characteristic in the fourth resonance mode is represented by (d).

In the antenna 101 according to the comparative example, a multiband operation is achieved by the antenna electrodes disposed on the same plane. Each of the antenna electrodes in the antenna 101, however, generates its own frequency band. Therefore, as illustrated in FIG. 3, a bandwidth is narrow in each of the resonance modes. Accordingly, it is difficult with the antenna 101 to widen bandwidths or fractional bandwidths. The term "fractional bandwidth" used herein refers to a ratio of a bandwidth BW with a reflectance of 10 dB or less to a center frequency f0 (i.e., BW/f0).

In contrast, in an antenna according to any embodiment of the disclosure described below, four or more antenna electrodes are distributed on at least two stacked planes. At least two of the antenna electrodes adjacent to each other in the stacking direction are coupled to each other to generate a single frequency band, thereby achieving a multiband antenna having two or more frequency bands as a whole. With the antenna in which at least two of the antenna electrodes adjacent to each other in the stacking direction are coupled to each other, it is possible to widen a bandwidth in each resonance mode.

An antenna electrode has a certain width. Therefore, in the antenna 101 according to the comparative example that includes the antenna electrodes simply disposed on the same plane, specific resonance frequencies of the respective antenna electrodes are too different from each other to effectively generate a broad frequency band by coupling the antenna electrodes to each other. In contrast, in the antenna according to any embodiment of the disclosure, multiple antenna electrodes are distributed on different planes. This configuration makes it possible to achieve a broad frequency band by coupling the antenna electrodes to each other.

1. FIRST EMBODIMENT (EXAMPLE CONFIGURATION OF ANTENNA INCLUDING ANTENNA ELECTRODE HAVING TWO-LAYERED STRUCTURE)

1.1 Example Configuration of Antenna of First Embodiment

Figure 4:
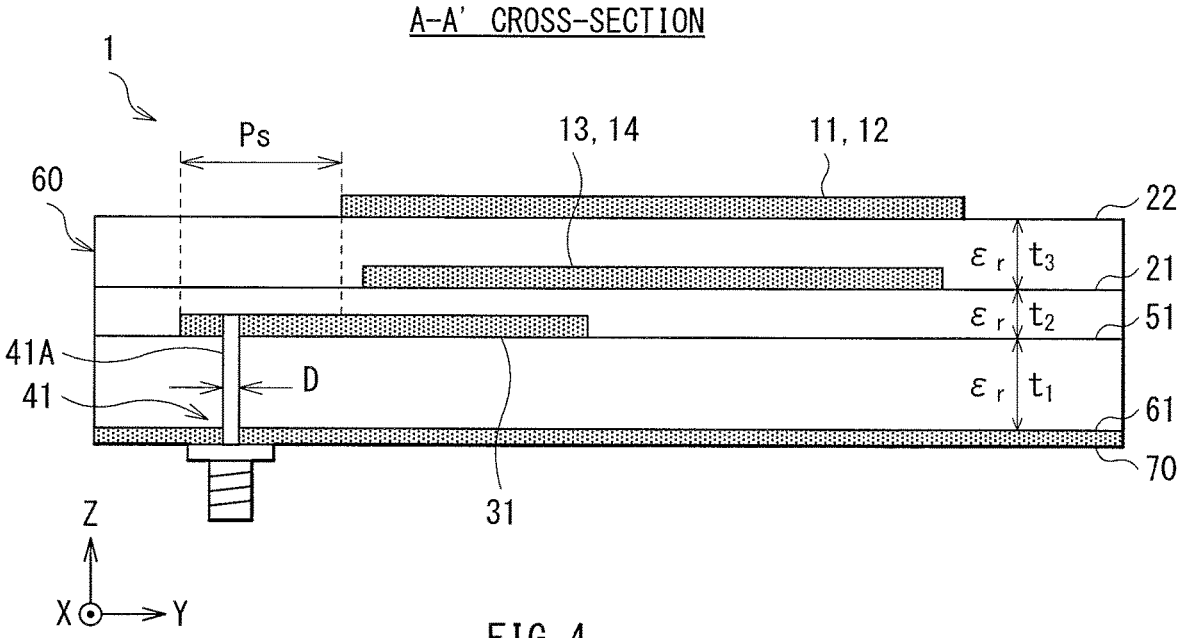
FIG. 4 is a cross-sectional view of an antenna according to a one embodiment of the disclosure.
Figure 5:
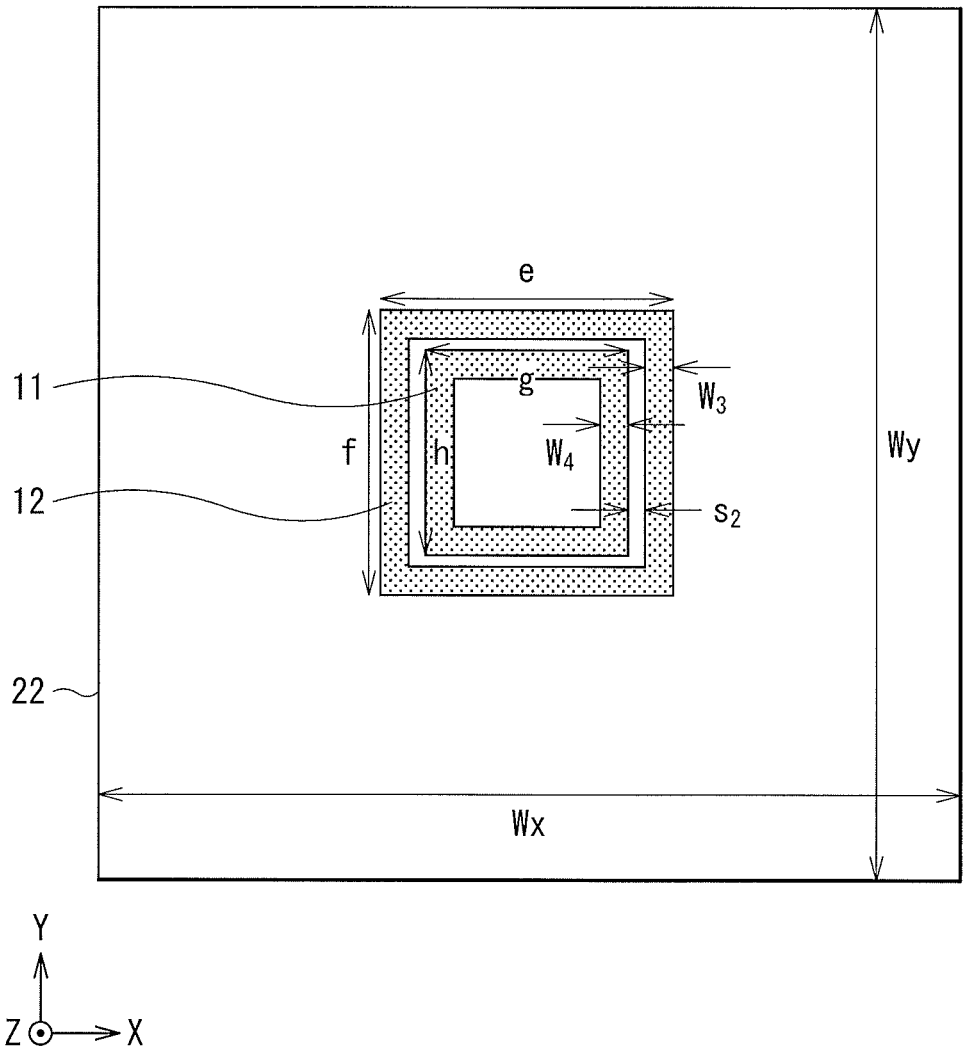
FIG. 5 is a plan view of a second antenna layer of the antenna according to one embodiment.
Figure 6:
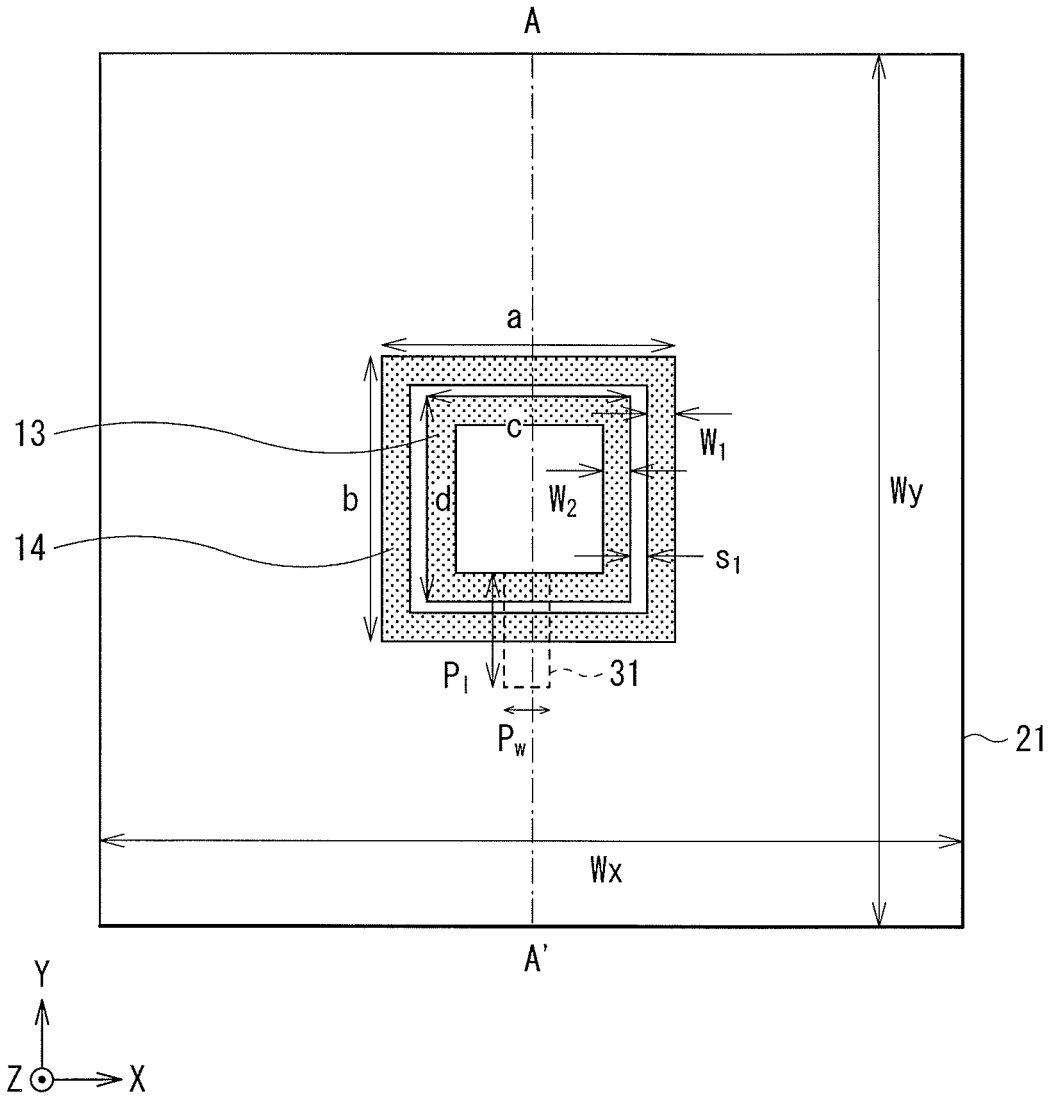
FIG. 6 is a plan view of a first antenna layer of the antenna according to one embodiment.

FIG. 4 illustrates an example cross-sectional configuration of an antenna 1 according to a first embodiment of the disclosure. FIG. 5 illustrates an example planar configuration of a second antenna layer 22 of the antenna 1. FIG. 6 illustrates an example cross-sectional configuration of a first antenna layer 21 of the antenna 1. FIG. 4 is a cross-sectional view of the antenna 1 taken along the line A-A' of FIG. 6.

The antenna 1 includes a dielectric 60. The dielectric 60 may have a plate shape and a laminated structure. The antenna 1 may include a ground layer 70, a probe layer 51, a first antenna layer 21, and a second antenna layer 22 that are laminated in this order from a bottom surface 61 of the dielectric 60.

The antenna 1 includes a first antenna electrode 11, a second antenna electrode 12, a third antenna electrode 13, and a fourth antenna electrode 14 each having an annular conductor pattern. The antenna 1 further includes a first probe electrode 31 and a first power-feed connector 41. The first probe electrode 31 may have a linear conductor pattern.

With reference to FIGS. 4 to 6, a Z-axis may extend along a stacking direction of the dielectric 60, and an X-axis and a Y-axis may be perpendicular to the Z-axis and orthogonal to each other. The X-Y plane may be parallel to first to forth planes and a fifth plane described herein. The same may be applied to modification examples and other embodiments of the disclosure described below.

The second antenna layer 22 of the antenna 1 may correspond to a specific but non-limiting example of the first plane and the second plane according to one embodiment of the disclosure. In other words, the second antenna layer 22 may correspond to a specific but non-limiting example of a first face according to one embodiment of the disclosure in a case where the first plane and the second plane are on the same plane. The first antenna layer 21 may correspond to a specific but non-limiting example of the third plane and the fourth plane according to one embodiment of the disclosure. In other words, the first antenna layer 21 may correspond to a specific but non-limiting example of a second face according to one embodiment of the disclosure in a case where the third plane and the fourth plane are on the same plane. The probe layer 51 may correspond to a specific but non-limiting example of the fifth plane.

The first antenna electrode 11 and the second antenna electrode 12 are disposed on the second antenna layer 22. The first antenna electrode 11 and the second antenna electrode 12 each have an annular shape and are different in size from each other. The second antenna electrode 12 may be larger in size than the first antenna electrode 11 and disposed outside the first antenna electrode 11.

The third antenna electrode 13 and the fourth antenna electrode 14 are disposed on the first antenna layer 21. The third antenna electrode 13 and the fourth antenna electrode 14 each have an annular shape and are different in size from each other. The fourth antenna electrode 14 may be larger in size than the third antenna electrode 13 and disposed outside the third antenna electrode 13.

The first antenna electrode 11 to the fourth antenna electrode 14 include the largest antenna electrode having an outer periphery and disposed most outside among the first to the fourth antenna electrodes. The remaining antenna electrodes other than the largest antenna electrode among the first to the fourth antenna electrodes are disposed inward from the outer periphery of the largest antenna electrode when seen in plan view along the stacking direction.

In the antenna 1, the second antenna electrode 12 may be the largest antenna electrode, the fourth antenna electrode 14 may be the second largest antenna electrode, the first antenna electrode 11 may be the third largest antenna electrode, and the third antenna electrode 13 may be the smallest antenna electrode.

The first antenna electrode 11 to the fourth antenna electrode 14 may be mirror symmetric about a first symmetry plane perpendicular to the X-Y plane. Additionally, the first antenna electrode 11 to the fourth antenna electrode 14 may be mirror symmetric about a second symmetry plane perpendicular to the X-Y plane and different from the first symmetry plane. The first symmetry plane and the second symmetry plane may be orthogonal to each other, for example. The first symmetry plane may extend through, for example, central portions of the first antenna electrode 11 to the fourth antenna electrode 14 when seen in plan view along the stacking direction, and may be parallel to the X-Z plane. The second symmetry plane may extend through, for example, central portions of the first antenna electrode 11 to the fourth antenna electrode 14 when seen in plan view along the stacking direction, and may be parallel to the Y-Z plane. Additionally, the first antenna electrode 11 to the fourth antenna electrode 14 may have rotational symmetry of 180 degrees about a rotation axis perpendicular to the X-Y plane. The rotation axis may extend through, for example, the central portions of the first antenna electrode 11 to the fourth antenna electrode 14 when seen in plan view along the stacking direction, and may be parallel to the Z-axis.

The first power-feed connector 41 may have a first through-conductor 41A. The first through-conductor 41A may extend through the ground layer 70 and the bottom surface 61 to the first probe electrode 31 of the dielectric 60. The first antenna electrode 11 to the fourth antenna electrode 14 may be electrically powered via the first power-feed connector 41 and the first probe electrode 31.

The first probe electrode 31 is disposed on the probe layer 51. The first probe electrode 31 overlaps one or both of the first antenna electrode 11 and the third antenna electrode 13 and one or both of the second antenna electrode 12 and the fourth antenna electrode 14 when seen in plan view along the stacking direction. This configuration allows the first antenna electrode 11 to the fourth antenna electrode 14 to be electrically powered via the first probe electrode 31. In the example configuration illustrated in FIGS. 4 to 6, the first probe electrode 31 overlaps all of the first antenna electrode 11 to the fourth antenna electrode 14 when seen in plan view along the stacking direction.

In an alternative embodiment, the probe layer 51 may be provided between the first antenna layer 21 and the second antenna layer 22.

When the first antenna electrode 11 to the fourth antenna electrode 14 are electrically powered via the first probe electrode 31 in the antenna 1, an electric current may flow in each of the antenna electrodes to cause each of the antenna electrodes to occur specific resonance based on the current path. The second antenna electrode 12 and the fourth antenna electrode 14 that are coupled and paired to each other may thus serve as an antenna operating in a frequency band centered on a first frequency fa. Additionally, the first antenna electrode 11 and the third antenna electrode 13 that are coupled and paired to each other may serve as an antenna operating in a frequency band centered on a second frequency fb.

In the antenna 1, the first probe electrode 31 may be disposed directly adjacent to the first antenna layer 21 in the stacking direction. The first probe electrode 31 overlaps the third antenna electrode 13 and the fourth antenna electrode 14 that are disposed on the first antenna layer 21 when seen in plan view along the stacking direction. This configuration allows the pair of the first antenna electrode 11 and the third antenna electrode 13 and the pair of the second antenna electrode 12 and the fourth antenna electrode 14 to be electrically powered via the first power-feed connector 41 and the first probe electrode 31. As described above, the first antenna electrode 11 may be coupled to the third antenna electrode 13 that is adjacent to the first probe electrode 31 in the stacking direction in the antenna 1. This configuration allows the first antenna electrode 11 to also be electrically powered via the third antenna electrode 13 despite that the first antenna electrode 11 is not adjacent to the first probe electrode 31 in the stacking direction. Likewise, the second antenna electrode 12 may be coupled to the fourth antenna electrode 14 that is adjacent to the first probe electrode 31 in the stacking direction. This configuration allows the second antenna electrode 12 to also be electrically powered via the fourth antenna electrode 14 despite that the second antenna electrode 12 is not adjacent to the first probe electrode 31 in the stacking direction.

In the antenna 1, the first antenna electrode 11 and the third antenna electrode 13 may each have a round-trip length smaller than those of the second antenna electrode 12 and the fourth antenna electrode 14, and the second frequency fb may be higher than the first frequency fa (fb>fa). Hereinafter, an operation mode centered on the first frequency fa, which is relatively low, may be referred to as a first mode, and an operation mode centered on the second frequency fb, which is relatively high, may be referred to as a second mode.

In the antenna 1, a specific resonance frequency f1 of the first antenna electrode 11, a specific resonance frequency f2 of the second antenna electrode 12, a specific resonance frequency f3 of the third antenna electrode 13, and a specific resonance frequency f4 of the fourth antenna electrode 14 may satisfy, for example, all of the following Expressions 1 to 8:

$$|f3-f1|<|f2-f1| \quad \text{Expression 1}$$

$$|f3-f1|<|f4-f1| \quad \text{Expression 2}$$

$$|f3-f1|<|f2-f3| \quad \text{Expression 3}$$

$$|f3-f1|<|f4-f3| \quad \text{Expression 4}$$

$$|f4-f2|<|f2-f1| \quad \text{Expression 5}$$

$$|f4-f2|<|f4-f1| \quad \text{Expression 6}$$

$$|f4-f2|<|f2-f3| \quad \text{Expression 7}$$

$$|f4-f2|<|f4-f3| \quad \text{Expression 8.}$$

This makes it possible to widen the bandwidth in each operation mode.

Alternatively, the first antenna electrode 11 and the third antenna electrode 13 may be adjusted in size (round-trip length) such that the specific resonance frequency f1 of the first antenna electrode 11 is equal to the specific resonance frequency f3 of the third antenna electrode 13 (i.e., f1=f3). Likewise, the second antenna electrode 12 and the fourth antenna electrode 14 may be adjusted in size (round-trip length) such that the specific resonance frequency f2 of the second antenna electrode 12 is equal to the specific resonance frequency f4 of the fourth antenna electrode (i.e., f2=f4). Even in such an alternative embodiment, a peak frequency may be split owing to the two antenna electrodes coupled and paired to each other. Accordingly, the antenna 1 makes it possible to achieve a frequency band broader than that of the antenna 101 according to the comparative example in which two antenna electrodes are not coupled to each other or are coupled to each other to a small extent and each of the antenna electrodes thus operates substantially independently in a corresponding operation mode.

[Antenna Characteristics]

Described below are results of a simulation of various antenna characteristics of the antenna 1 according to the first embodiment of the disclosure. In the simulation, dimensions and other parameters of portions of the antenna 1 illustrated in FIGS. 4 to 6 were as follows:

Wx=8.0, Wy=8.0, a=b=1.84, c=d=1.40, e=f=2.00, g=h=1.60, $w_1$=0.17, $w_2$=0.18, $w_3$=0.15, $w_4$=0.21, $s_1$=0.05, $s_2$=0.05, $P_w$=0.2, $P_s$=1.11, $P_1$=1.59, D=0.1, $t_1$=0.4, $t_2$=0.1, $t_3$=0.2, εr=2.9 where "εr" denotes a relative dielectric constant of the dielectric 60, and the reference characters other than "εr" denote respective dimensions in unit of millimeter [mm].

The round-trip lengths L1 to L4 and the specific resonance frequencies f1 to f4 of the first antenna electrode 11 to the fourth antenna electrode 14 were as follows:

L1=5.56 mm, f1=33.7 GHz

L2=7.40 mm, f2=24.80 GHz

L3=4.48 mm, f3=37.9 GHz

L4=6.68 mm, f4=27.50 GHz where each of the round-trip lengths L1 to L4 of the first antenna electrode 11 to the fourth antenna electrode 14 corresponds to a round-trip length along the widthwise center of the corresponding antenna electrode.

Figure 7:
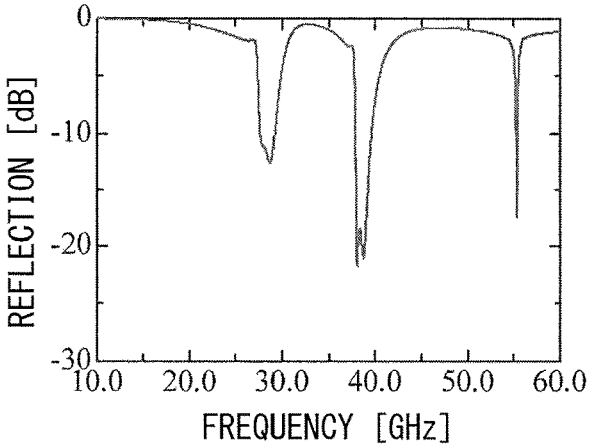
FIG. 7 is a diagram illustrating the entire reflectance of the antenna according to one embodiment.
Figure 8:
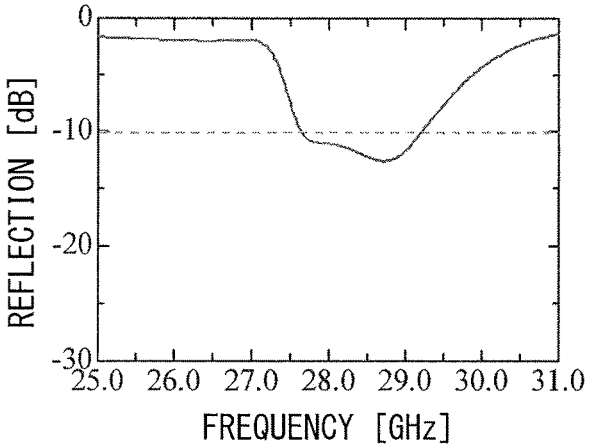
FIG. 8 is an enlarged diagram illustrating a reflectance in a first mode of the antenna according to one embodiment.
Figure 9:
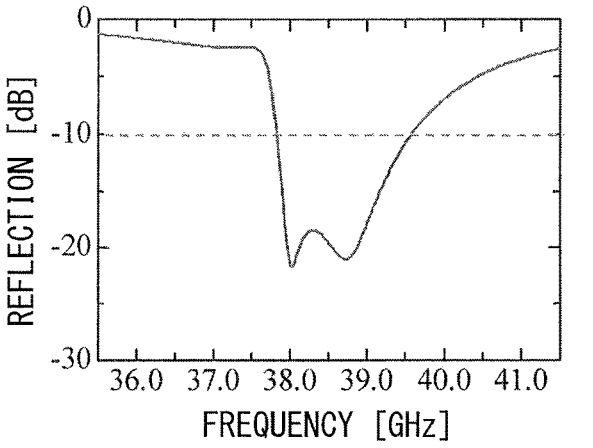
FIG. 9 is an enlarged diagram illustrating a reflectance in a second mode of the antenna according to one embodiment.

FIG. 7 illustrates the result of a simulation of the entire reflectance of the antenna 1. FIG. 8 illustrates the reflectance of the antenna 1 in the first mode in an enlarged manner. FIG. 9 illustrates the reflectance of the antenna 1 in the second mode in an enlarged manner.

FIGS. 7 to 9 demonstrate that a broad frequency band was achieved in each operation mode.

1.2 Modification Example of First Embodiment

First Modification Example

Figure 10:
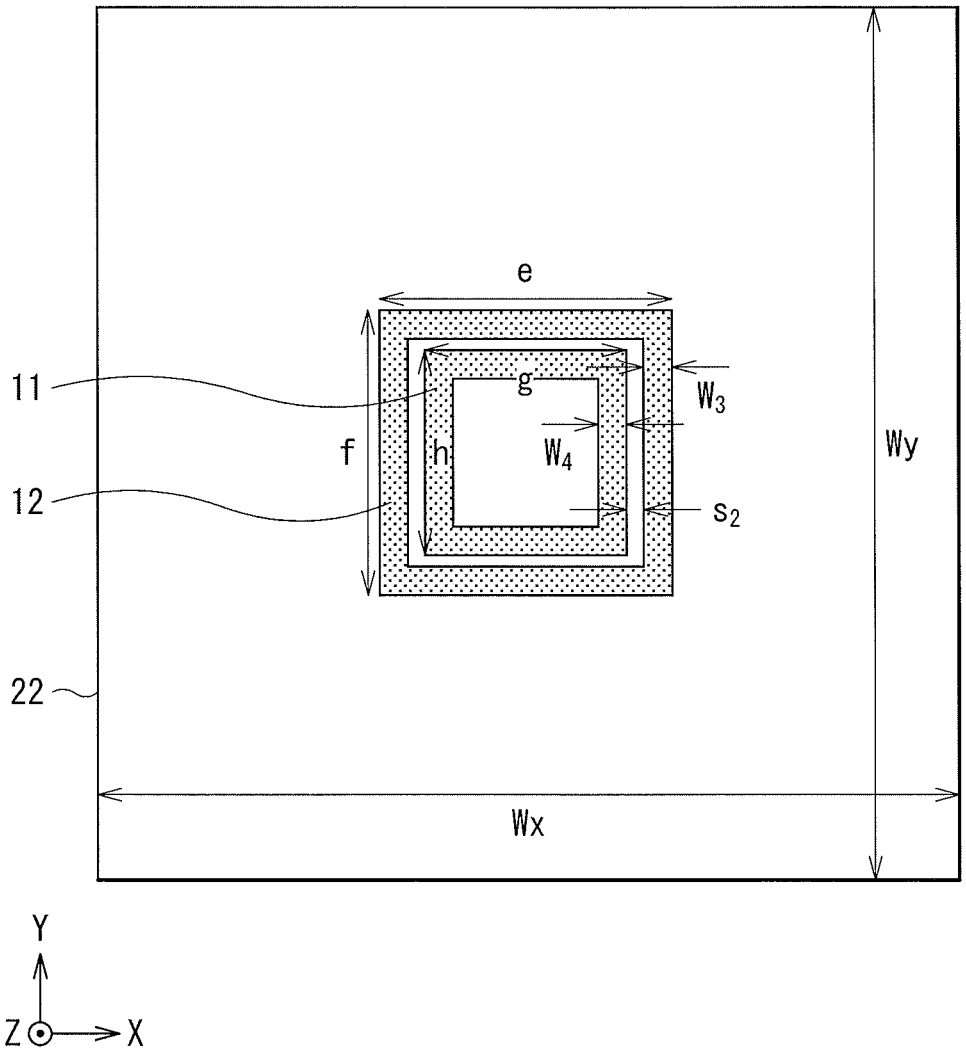
FIG. 10 is a plan view of a second antenna layer of the antenna according to a first modification example of one embodiment.
Figure 11:
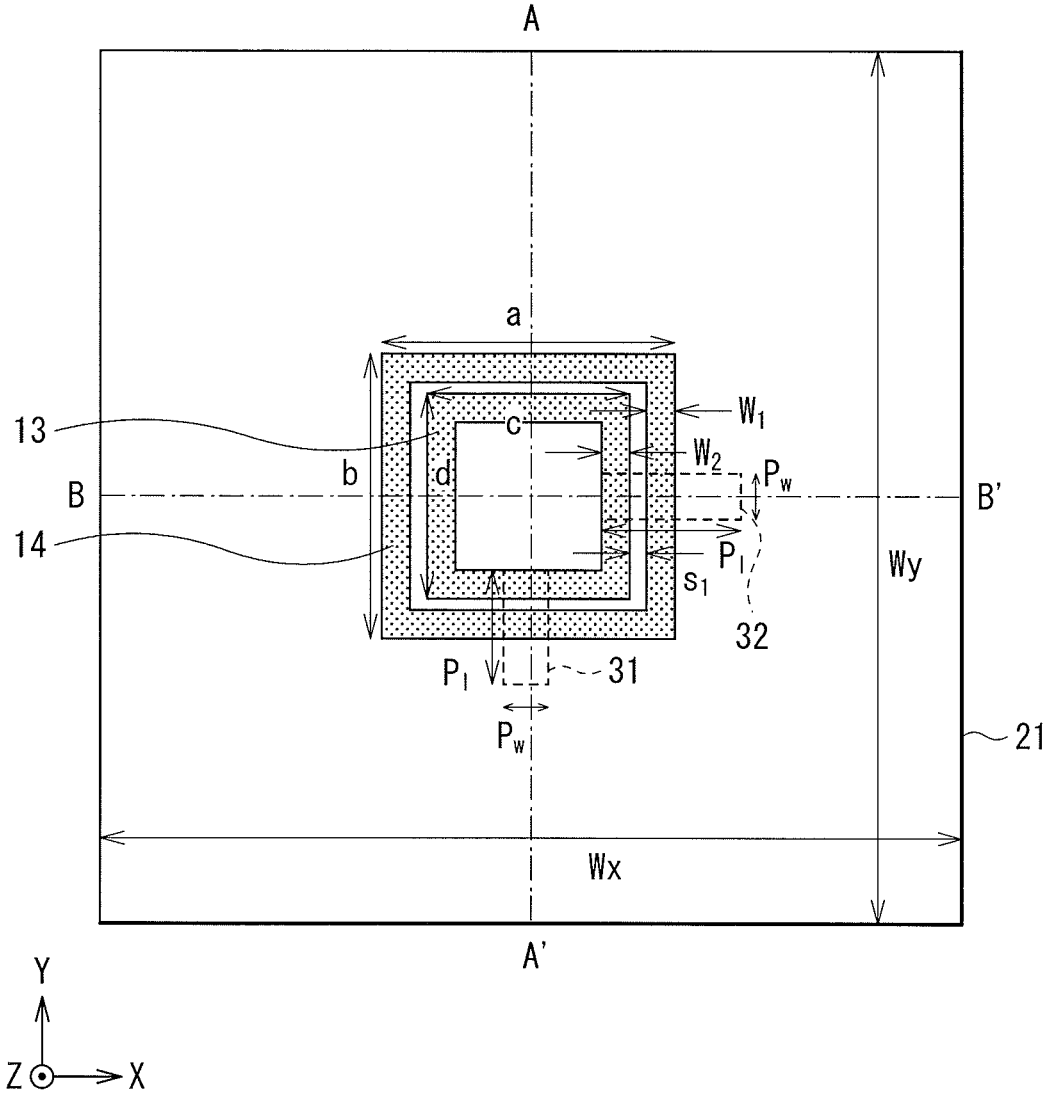
FIG. 11 is a plan view of a first antenna layer of an antenna according to the first modification example of one embodiment.
Figure 12:
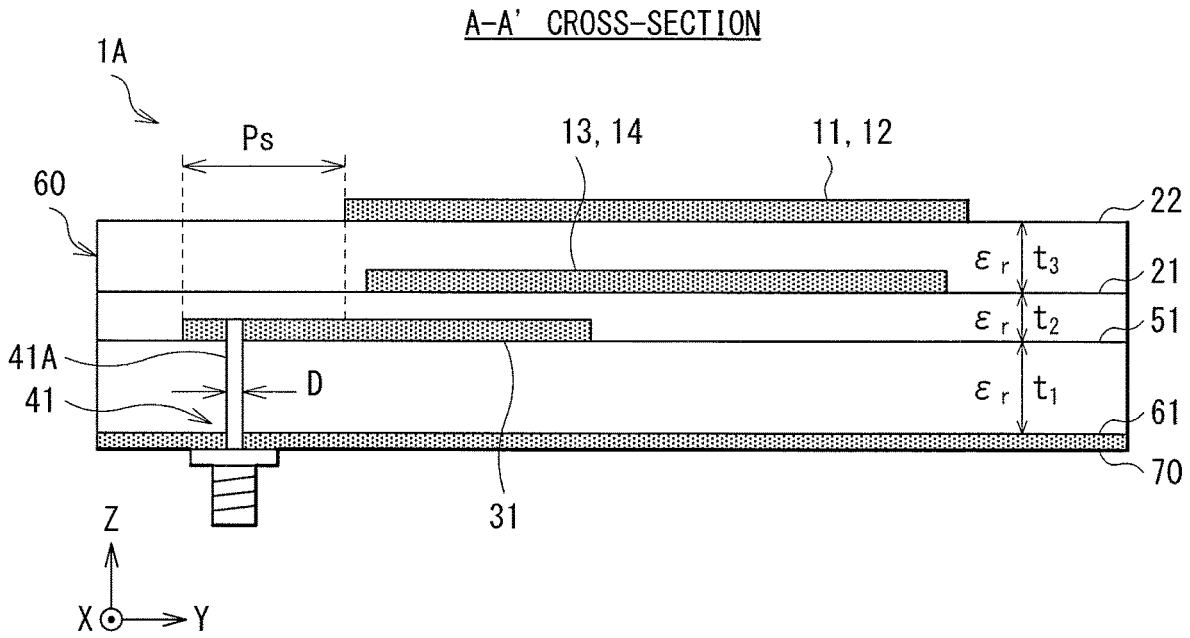
FIG. 12 is a first cross-sectional view of the antenna according to the first modification example of one embodiment.
Figure 13:
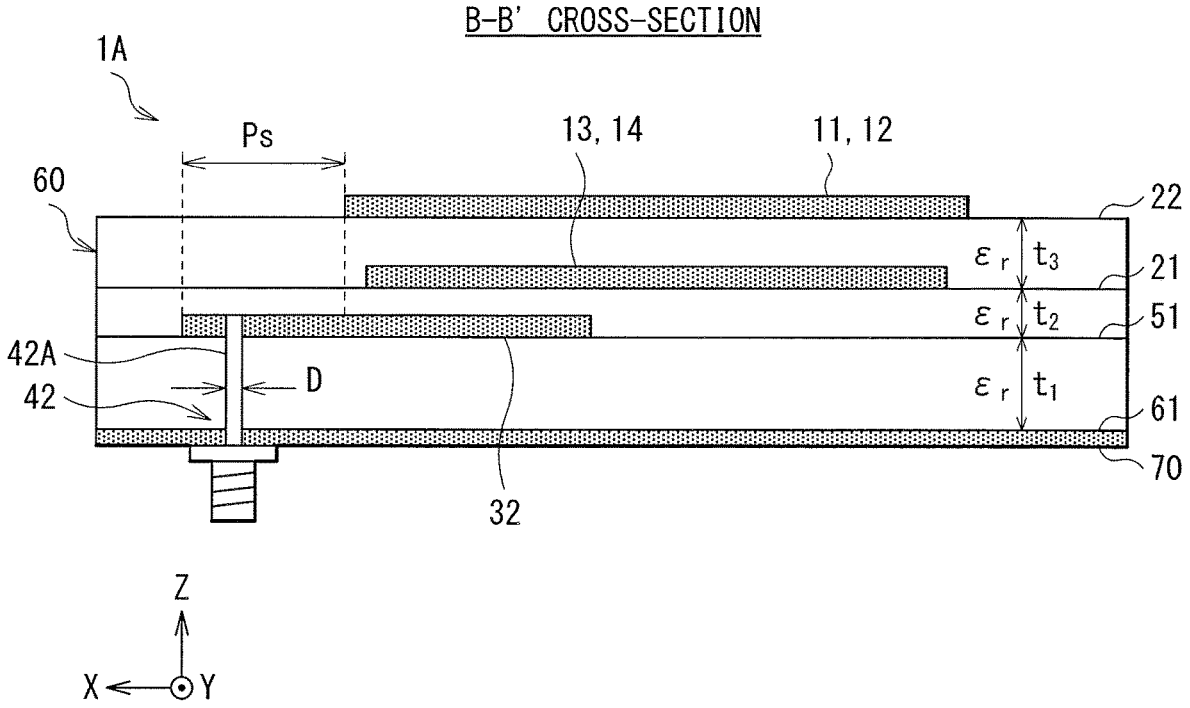
FIG. 13 is a second cross-sectional view of the antenna according to the first modification example of one embodiment.

FIG. 10 illustrates an example planar configuration of a second antenna layer 22 of an antenna 1A according to a first modification example of the first embodiment of the disclosure. FIG. 11 illustrates an example planar configuration of a first antenna layer 21 of the antenna 1A. FIG. 12 illustrates an example of a first cross-section of the antenna 1A. FIG. 13 illustrates an example of a second cross-section of the antenna 1A. FIG. 12 is a cross-sectional view of the antenna 1A taken along the line A-A' in FIG. 11. FIG. 13 is a cross-sectional view of the antenna 1A taken along the line B-B' in FIG. 11.

The antenna 1A according to the first modification example may further include a second probe electrode 32 and a second power-feed connector 42 in addition to the components of the antenna 1 illustrated in FIGS. 4 to 6.

Like the first probe electrode 31, the second probe electrode 32 may have a linear conductor pattern and is disposed on the probe layer 51.

The second power-feed connector 42 may have a second through-conductor 42A. The second through-conductor 42A may extend through the ground layer 70 and the bottom surface 61 to the second probe electrode 32 of the dielectric 60. The first antenna electrode 11 to the fourth antenna electrode 14 may be electrically powered via the first power-feed connector 41 and the first probe electrode 31, and via the second power-feed connector 42 and the second probe electrode 32. The first probe electrode 31 and the second probe electrode 32 may be excited differentially with each other.

Like the first probe electrode 31, the second probe electrode 32 overlaps one or both of the first antenna electrode 11 and the third antenna electrode 13 and one or both of the second antenna electrode 12 and the fourth antenna electrode 14 when seen in plan view along the stacking direction. This configuration allows the first antenna electrode 11 to the fourth antenna electrode 14 to be electrically powered via the first probe electrode 31 and the second probe electrode 32. In the example configuration illustrated in FIGS. 10 to 13, the first probe electrode 31 and the second probe electrode 32 overlap all of the first antenna electrode 11 to the fourth antenna electrode 14 when seen in plan view along the stacking direction.

In the antenna 1A, the second probe electrode 32 may be disposed at a position shifted by 90 degrees from the position of the first probe electrode 31 when seen in plan view along the stacking direction.

In the antenna 1A, the first probe electrode 31 and the second probe electrode 32 may be disposed directly adjacent to the first antenna layer 21 in the stacking direction. The first probe electrode 31 and the second probe electrode 32 each overlap the third antenna electrode 13 and the fourth antenna electrode 14 that are disposed on the first antenna layer 21 when seen in plan view along the stacking direction. This configuration allows the pair of the first antenna electrode 11 and the third antenna electrode 13 and the pair of the second antenna electrode 12 and the fourth antenna electrode 14 to be electrically powered via the first power-feed connector 41 and the first probe electrode 31 and via the second power-feed connector 42 and the second probe electrode 32. In the antenna 1A, the first antenna electrode 11 may be coupled to the third antenna electrode 13 that is adjacent to the first probe electrode 31 and the second probe electrode 32 in the stacking direction, as in the antenna 1 illustrated in FIGS. 4 to 6. This configuration allows the first antenna electrode 11 to also be electrically powered via the third antenna electrode 13 despite that the first antenna electrode 11 is not adjacent to the first probe electrode 31 and the second probe electrode 32 in the stacking direction. Likewise, the second antenna electrode 12 may be coupled to the fourth antenna electrode 14 that is adjacent to the first probe electrode 31 and the second probe electrode 32 in the stacking direction. This configuration allows the second antenna electrode 12 to also be electrically powered via the fourth antenna electrode 14 despite that the second antenna electrode 12 is not adjacent to the first probe electrode 31 and the second probe electrode 32 in the stacking direction.

In an alternative embodiment, the probe layer 51 may be provided between the first antenna layer 21 and the second antenna layer 22.

When the first antenna electrode 11 to the fourth antenna electrode 14 are electrically powered via the first probe electrode 31 and the second probe electrode 32 in the antenna 1A, an electric current may flow in each of the antenna electrodes to cause each of the antenna electrodes to occur specific resonance based on the current path. The second antenna electrode 12 and the fourth antenna electrode 14 that are coupled and paired to each other may thus serve as an antenna operating in a frequency band centered on the first frequency fa. Additionally, the first antenna electrode 11 and the third antenna electrode 13 that are coupled and paired to each other may serve as an antenna operating in a frequency band centered on the second frequency fb.

In the antenna 1A, the second probe electrode 32 may be disposed at a position shifted by 90 degrees from the position of the first probe electrode 31 when seen in plan view along the stacking direction. This configuration allows the antenna 1A to transmit two independent polarized waves orthogonal to each other in the frequency band centered on the first frequency fa and the frequency band centered on the second frequency fb.

Example dimensions and other parameters of portions of the antenna 1A illustrated in FIGS. 10 to 13 are as follows:

Wx=8.0, Wy=8.0, a=b=1.84, c=d=1.40, e=f=2.00, g=h=1.60, $w_1$=0.17, $w_2$=0.18, $w_3$=0.15, $w_4$=0.21, $s_1$=0.05, $s_2$=0.05, $P_w$=0.2, $P_s$=1.11, $P_1$=1.59, D=0.1, $t_1$=0.4, $t_2$=0.1, $t_3$=0.2, εr=2.9 where "εr" denotes a relative dielectric constant of the dielectric 60, and the reference characters other than "εr" denote respective dimensions in unit of millimeter [mm].

Other configurations and operations of the antenna 1A may be substantially similar to those of the antenna 1 according to the first embodiment.

Second Modification Example

Figure 14:
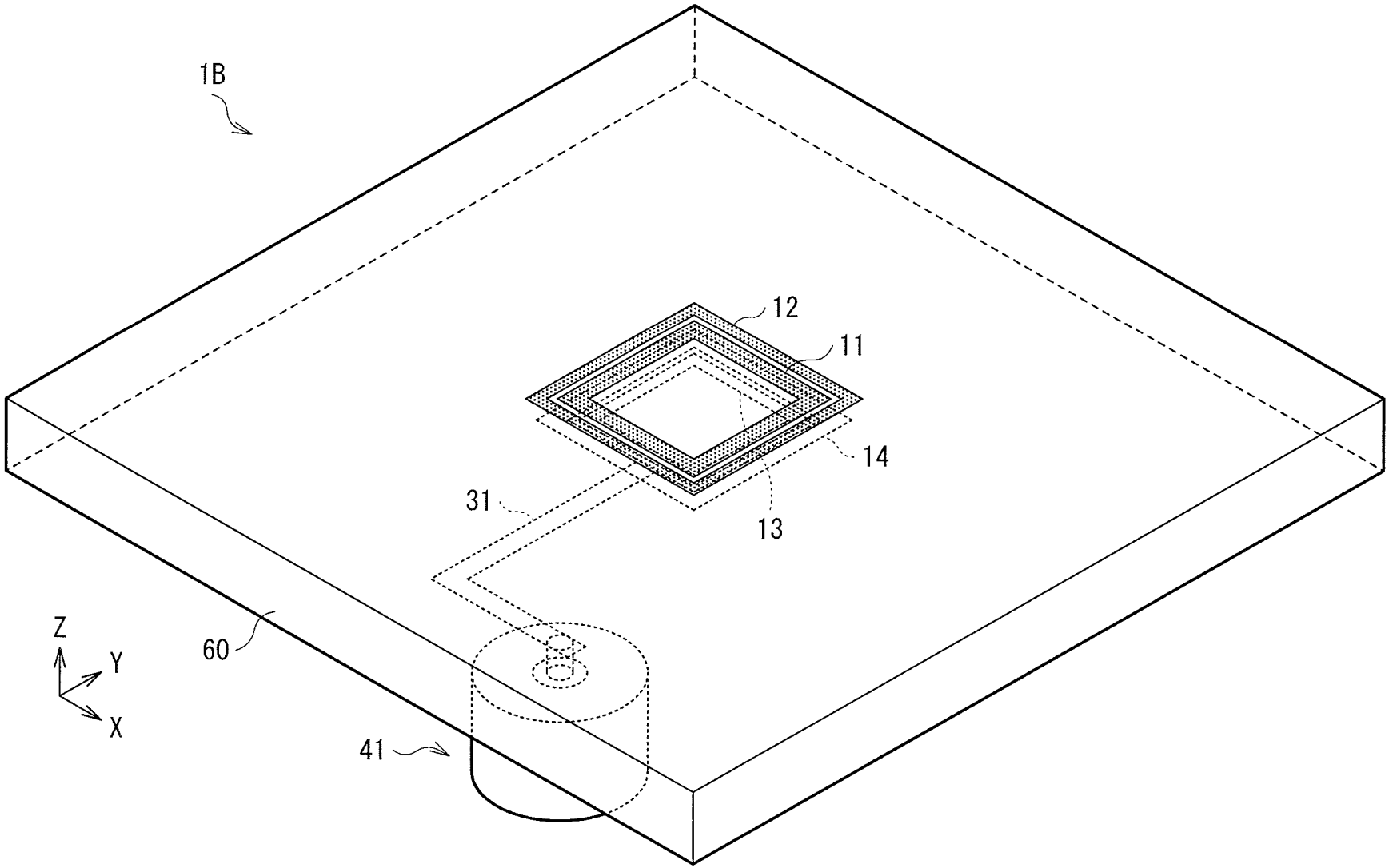
FIG. 14 is a perspective view of an antenna according to a second modification example of one embodiment.

FIG. 14 illustrates an example perspective configuration of an antenna 1B according to a second modification example of the first embodiment.

The antenna 1B according to the second modification example may be different from the antenna 1 illustrated in FIGS. 4 to 6 in a planar shape of the first probe electrode 31. The first probe electrode 31 of the antenna 1B may have an asymmetric shape, such as an L-shape, when seen in plan view along the stacking direction. In the example illustrated in FIG. 14, the first probe electrode 31 may have a shape asymmetric to the second symmetry plane when seen in plan view along the stacking direction.

Other configurations and operations of the antenna 1B may be substantially similar to those of the antenna 1 according to the first embodiment.

Figure 15:
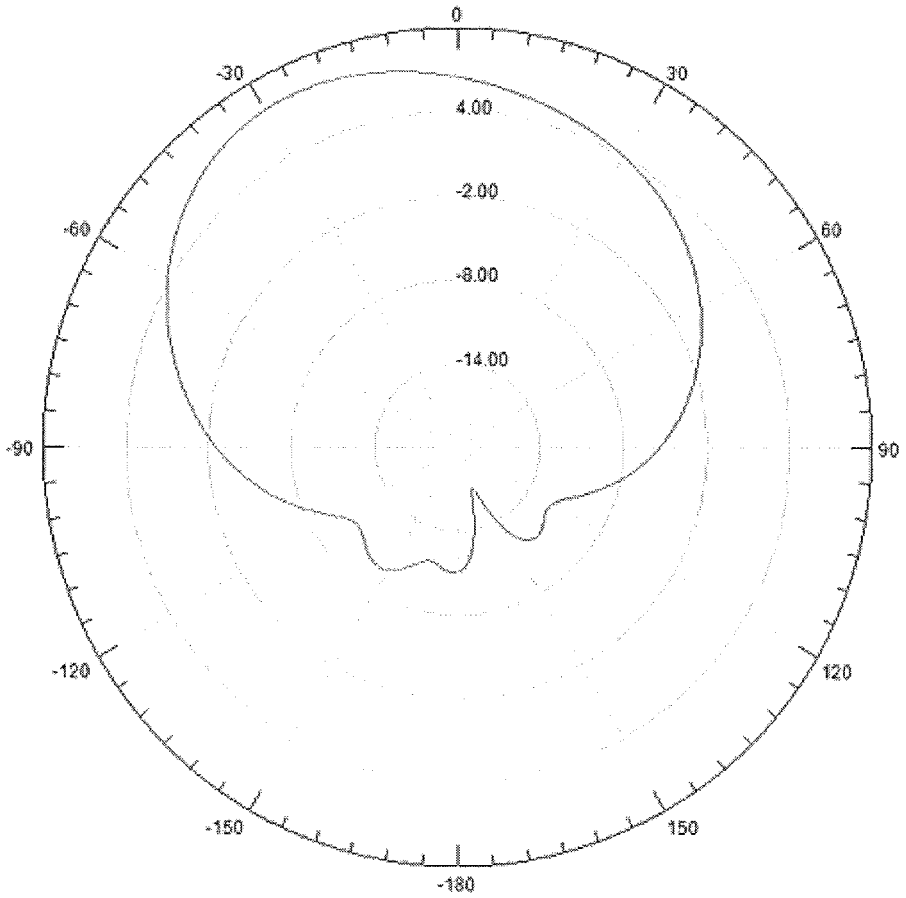
FIG. 15 is a diagram illustrating a radiation pattern at a frequency f of 28.0 GHz on an E-plane of the antenna according to the second modification example of one embodiment.

FIG. 15 illustrates the result of a simulation of a radiation pattern at a frequency f of 28.0 GHz on an E-plane of the antenna 1B according to the second modification example.

As apparent from FIG. 15, the radiation pattern of the antenna 1B loses symmetry and is not balanced. This is attributed to the asymmetric planar shape of the first probe electrode 31.

Third Modification Example

Figure 16:
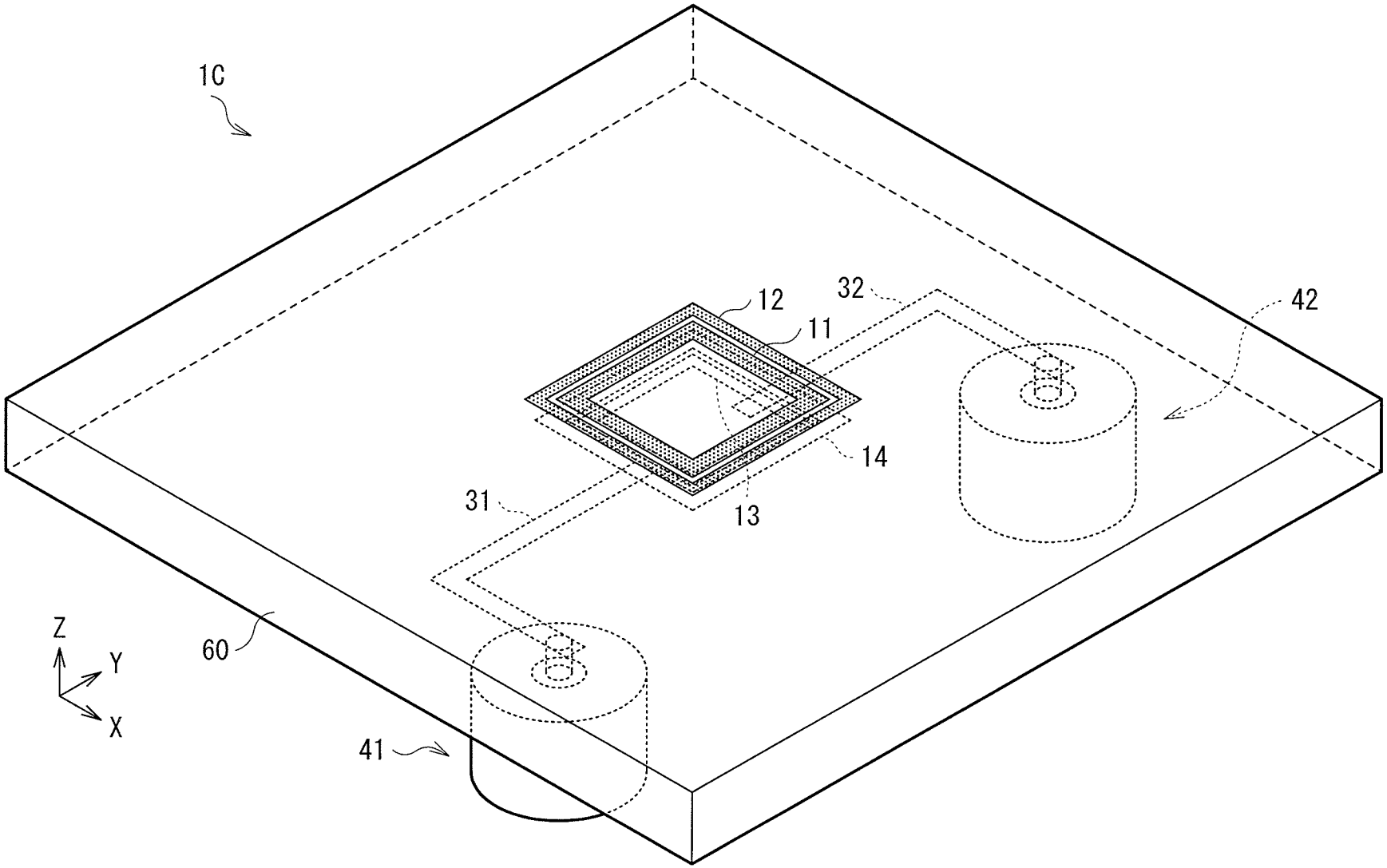
FIG. 16 is a perspective view of an antenna according to a third modification example of one embodiment.

FIG. 16 illustrates an example perspective configuration of an antenna 1C according to a third modification example of the first embodiment.

Like the antenna 1A according to the first modification example illustrated in FIGS. 10 to 13, the antenna 1C according to the third modification example includes the first probe electrode 31 and the second probe electrode 32. The antenna 1C may be different from the antenna 1A in the planar shapes of the first probe electrode 31 and the second probe electrode 32. The first probe electrode 31 and the second probe electrode 32 of the antenna 1C may each have an asymmetric shape, such as an L-shape, when seen in plan view along the stacking direction. In the example illustrated in FIG. 16, the first probe electrode 31 and the second probe electrode 32 may each have a shape asymmetric to the second symmetry plane when seen in plan view along the stacking direction.

Additionally, the first probe electrode 31 and the second probe electrode 32 of the antenna 1C may be mirror symmetric about the first symmetry plane perpendicular to the X-Y plane. The first symmetry plane may extend through central portions of the first antenna electrode 11 to the fourth antenna electrode 14 when seen in plan view along the stacking direction, and may be parallel to the X-Z plane.

The first antenna electrode 11 to the fourth antenna electrode 14 may be differentially electrically powered via the first power-feed connector 41 and the first probe electrode 31 and via the second power-feed connector 42 and the second probe electrode 32. The first probe electrode 31 and the second probe electrode 32 may be excited differentially with each other.

Other configurations and operations of the antenna 1C may be substantially similar to those of the antenna 1A according to the first modification example of the first embodiment.

Figure 17:
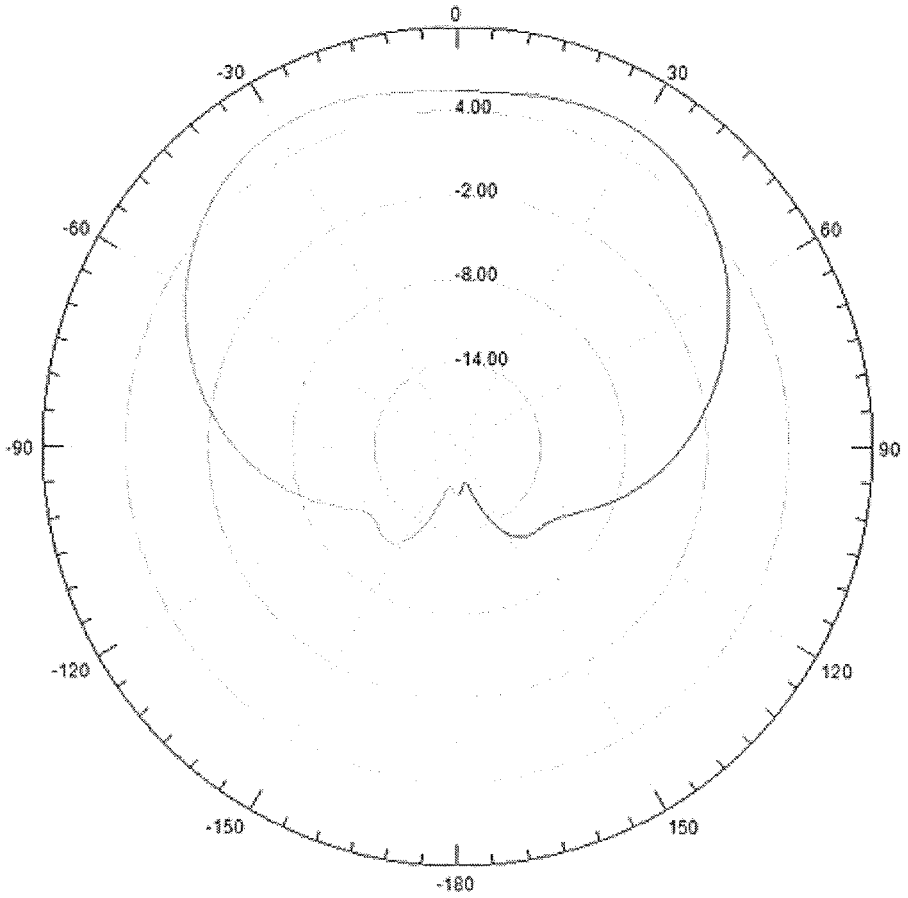
FIG. 17 is a diagram illustrating a radiation pattern at a frequency f of 28.0 GHz on an E-plane of the antenna according to the third modification example of one embodiment.

FIG. 17 illustrates the result of a simulation of a radiation pattern at a frequency f of 28.0 GHz on an E-plane of the antenna 1C according to the third modification example.

As apparent from FIG. 17, the radiation pattern of the antenna 1C is symmetrical and well-balanced compared with that of the antenna 1B according to the second modification example illustrated in FIGS. 14 and 15. This is attributed to the first probe electrode 31 and the second probe electrode 32 that are mirror symmetrical to each other.

Fourth Modification Example

Figure 18:
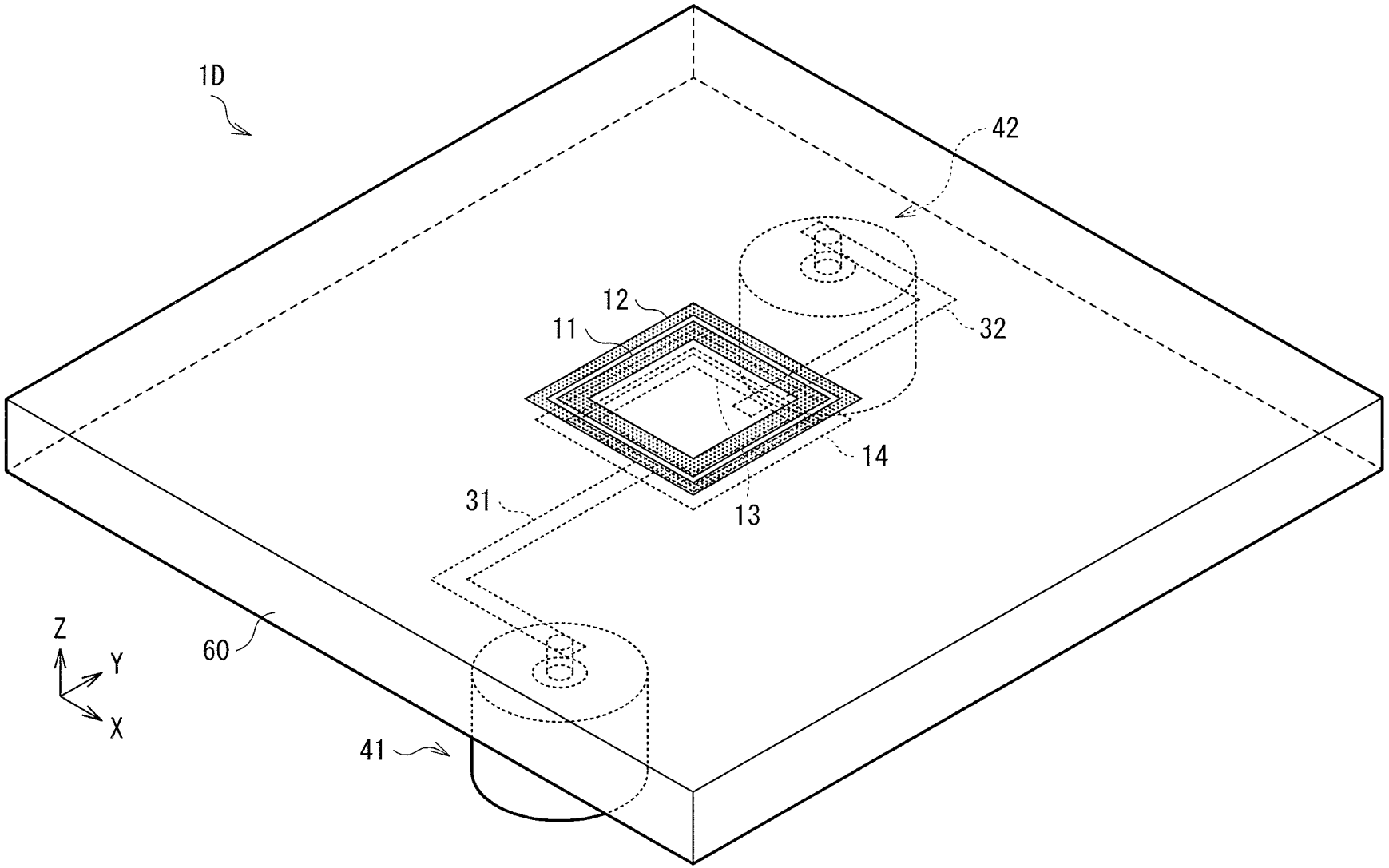
FIG. 18 is a perspective view of an antenna according to a fourth modification example of one embodiment.

FIG. 18 illustrates an example perspective configuration of an antenna 1D according to a fourth modification example of the first embodiment.

Like the antenna 1A according to the first modification example illustrated in FIGS. 10 to 13, the antenna 1D according to the fourth modification example includes the first probe electrode 31 and the second probe electrode 32. The antenna 1D may be different from the antenna 1A in the planar shapes of the first probe electrode 31 and the second probe electrode 32. The first probe electrode 31 and the second probe electrode 32 of the antenna 1D may each have an asymmetric shape, such as an L-shape, when seen in plan view along the stacking direction. In the example illustrated in FIG. 18, the first probe electrode 31 and the second probe electrode 32 may each have a shape asymmetric to the second symmetry plane when seen in plan view along the stacking direction.

Additionally, the first probe electrode 31 and the second probe electrode 32 of the antenna 1D may have rotational symmetry of 180 degrees about a rotation axis perpendicular to the X-Y plane. The rotation axis may extend through the central portions of the first antenna electrode 11 to the fourth antenna electrode 14 when seen in plan view along the stacking direction, and may be parallel to the Z-axis.

Other configurations and operations of the antenna 1D may be substantially similar to those of the antenna 1A according to the first modification example of the first embodiment.

Figure 19:
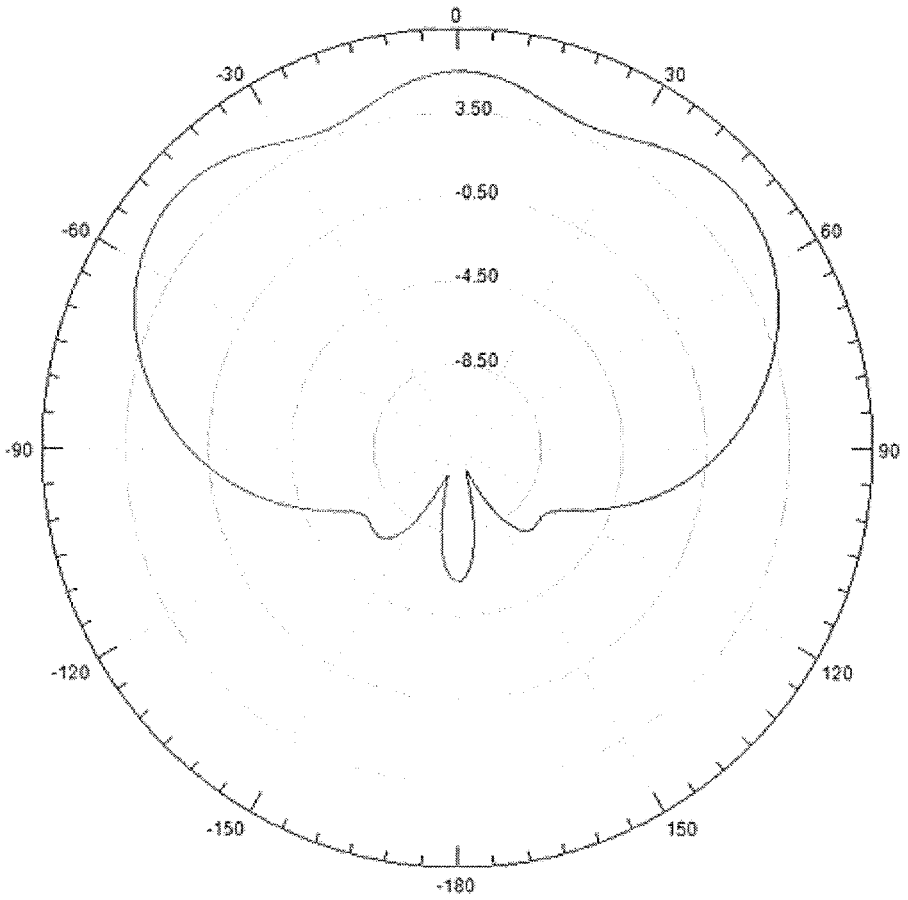
FIG. 19 is a diagram illustrating a radiation pattern at a frequency of 28.0 GHz on an E-plane of the antenna according to the fourth modification example of one embodiment.

FIG. 19 illustrates the result of a simulation of a radiation pattern at a frequency of 28.0 GHz on an E-plane of the antenna 1D according to the fourth modification example.

As apparent from FIG. 19, the radiation pattern of the antenna 1D is symmetrical and well-balanced compared with that of the antenna 1B according to the second modification example illustrated in FIGS. 14 and 15. This is attributed to the first probe electrode 31 and the second probe electrode 32 that have rotational symmetry of 180 degrees.

Fifth Modification Example

Figure 20:
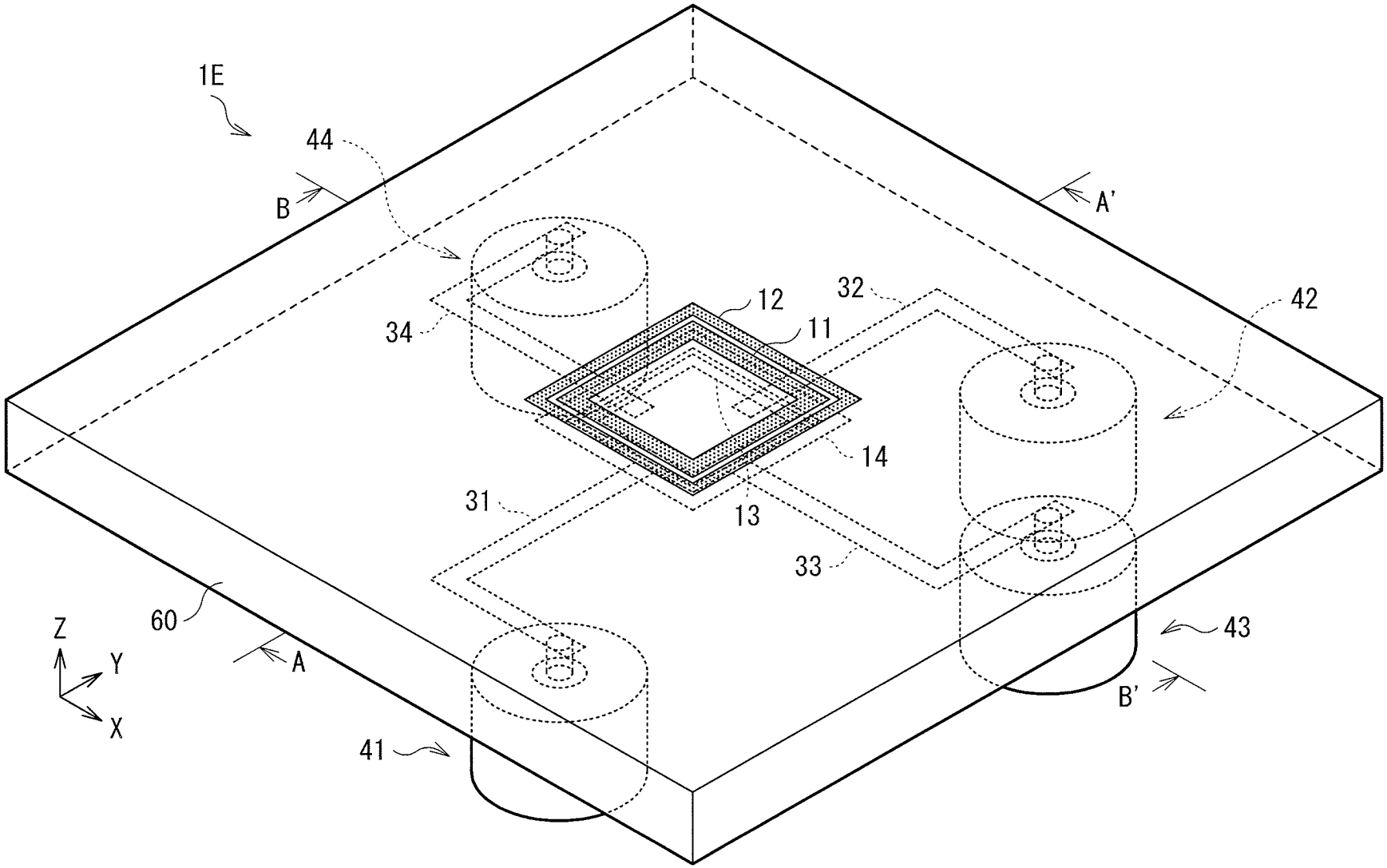
FIG. 20 is a perspective view of an antenna according to a fifth modification example of one embodiment.
Figure 21:
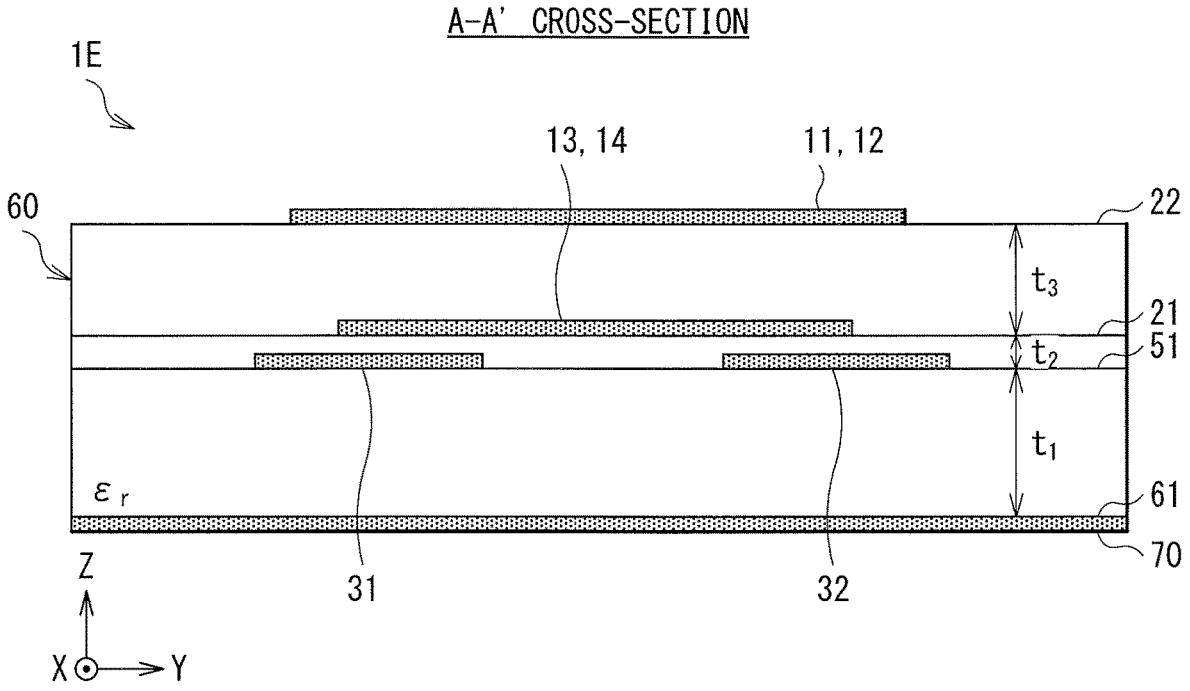
FIG. 21 is a first cross-sectional view of the antenna according to the fifth modification example of one embodiment.
Figure 22:
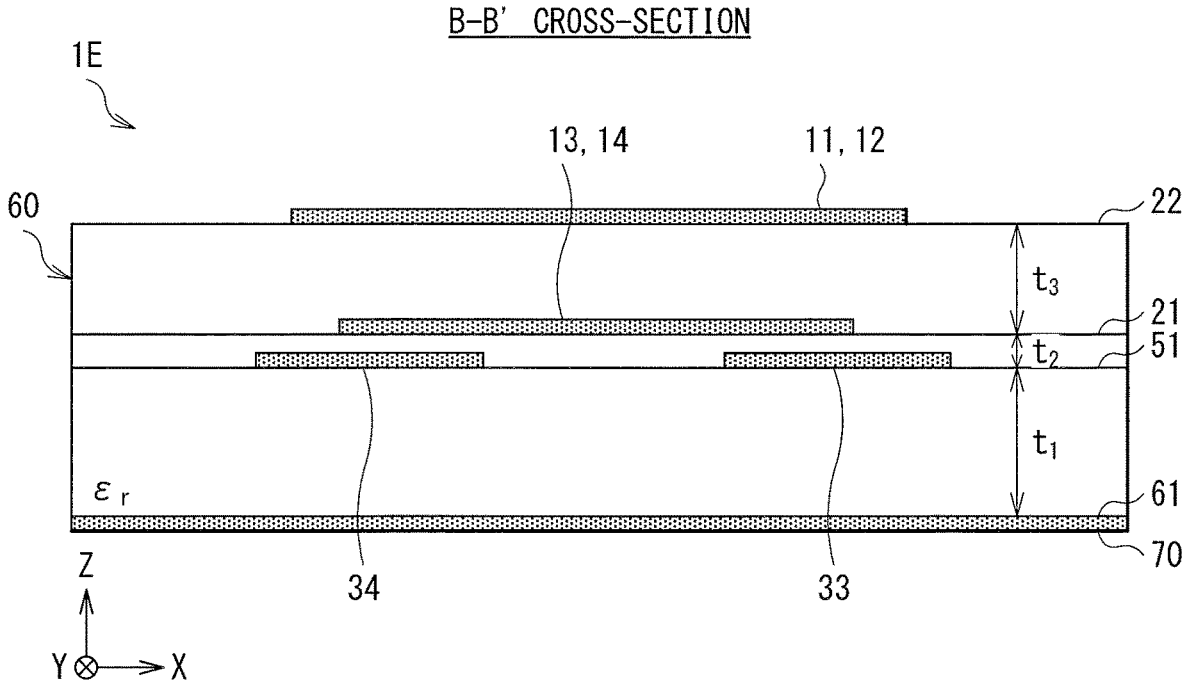
FIG. 22 is a second cross-sectional view of the antenna according to the fifth modification example of one embodiment.
Figure 23:
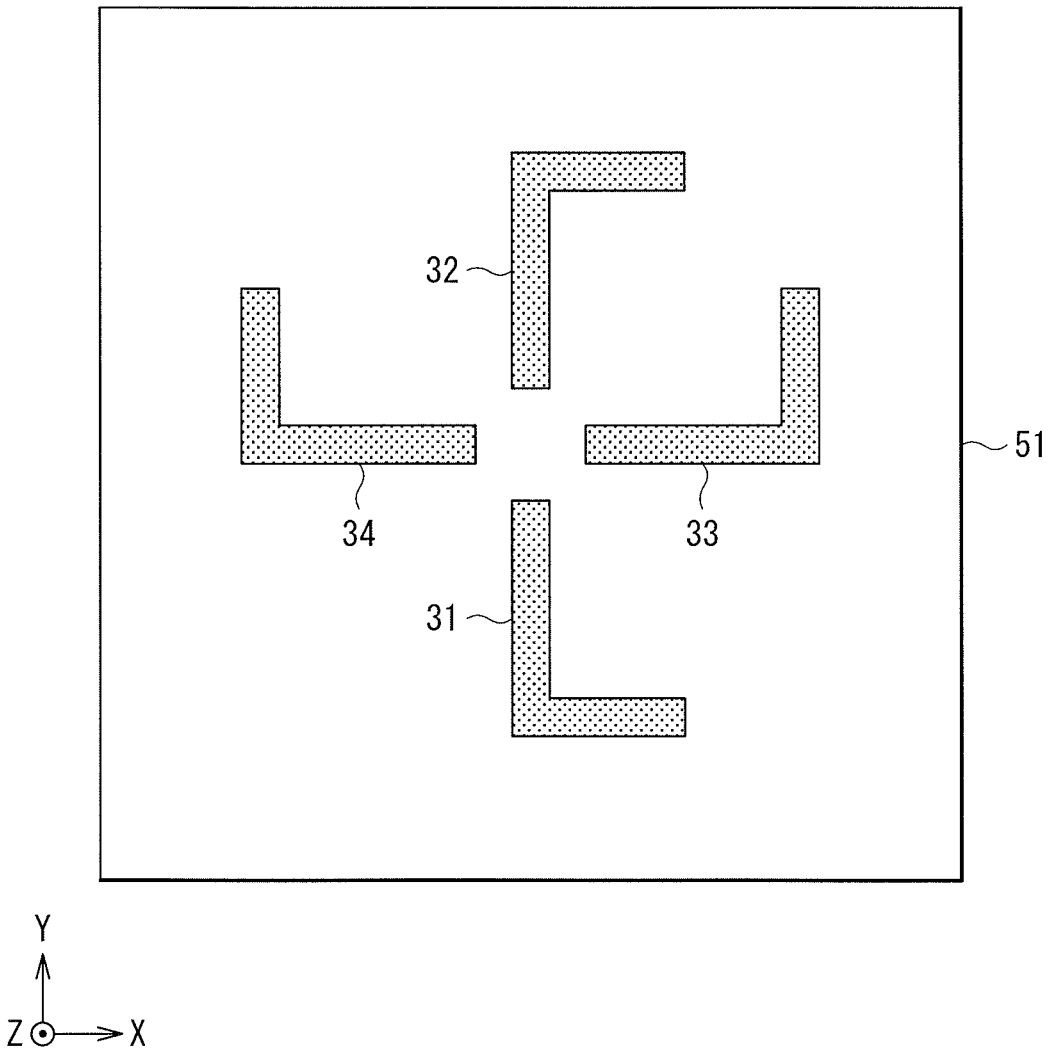
FIG. 23 is a plan view of a probe layer of the antenna according to the fifth modification example of one embodiment.

FIG. 20 illustrates an example perspective configuration of an antenna 1E according to a fifth modification example of the first embodiment. FIG. 21 illustrates an example of a first cross-section of the antenna 1E. FIG. 22 illustrates an example of a second cross-section of the antenna 1E. FIG. 23 illustrates an example planar configuration of the probe layer 51 of the antenna 1E. FIG. 21 is a cross-sectional view of the antenna 1E taken along the line A-A' of FIG. 20. FIG. 22 is a cross-sectional view of the antenna 1E taken along the line B-B' of FIG. 20.

The antenna 1E according to the fifth modification example may further include a third probe electrode 33, a third power-feed connector 43, a fourth probe electrode 34, and a fourth power-feed connector 44 in addition to the components of the antenna 1C according to the third modification example illustrated in FIG. 16.

Like the first probe electrode 31 and the second probe electrode 32, the third probe electrode 33 and the fourth probe electrode 34 are disposed on the probe layer 51.

The first antenna electrode 11 to the fourth antenna electrode 14 may be differentially electrically powered via the first power-feed connector 41 and the first probe electrode 31, via the second power-feed connector 42 and the second probe electrode 32, via the third power-feed connector 43 and the third probe electrode 33, and via the fourth power-feed connector 44 and the fourth probe electrode 34. The first probe electrode 31 and the second probe electrode 32 may be excited differentially with each other. Additionally, the third probe electrode 33 and the fourth probe electrode 34 may be excited differentially with each other.

Like the first probe electrode 31 and the second probe electrode 32, the third probe electrode 33 and the fourth probe electrode 34 overlap one or both of the first antenna electrode 11 and the third antenna electrode 13 and one or both of the second antenna electrode 12 and the fourth antenna electrode 14 when seen in plan view along the stacking direction. This configuration allows the first antenna electrode 11 to the fourth antenna electrode 14 to be electrically powered via the first probe electrode 31 to the fourth probe electrode 34. In the example configuration illustrated in FIGS. 20 to 23, the first probe electrode 31 to the fourth probe electrode 34 overlap all of the first antenna electrode 11 to the fourth antenna electrode 14 when seen in plan view along the stacking direction.

In the antenna 1E, the first probe electrode 31 to the fourth probe electrode 34 may be disposed directly adjacent to the first antenna layer 21 in the stacking direction. The first probe electrode 31 to the fourth probe electrode 34 each overlap the third antenna electrode 13 and the fourth antenna electrode 14 that are disposed on the first antenna layer 21 when seen in plan view along the stacking direction. This configuration allows the pair of the first antenna electrode 11 and the third antenna electrode 13 and the pair of the second antenna electrode 12 and the fourth antenna electrode 14 to be differentially electrically powered via the first power-feed connector 41 and the first probe electrode 31, via the second power-feed connector 42 and the second probe electrode 32, via the third power-feed connector 43 and the third probe electrode 33, and via the fourth power-feed connector 44 and the fourth probe electrode 34. In the antenna 1E, the first antenna electrode 11 may be coupled to the third antenna electrode 13 that is adjacent to the first probe electrode 31 to the fourth probe electrode 34 in the stacking direction, as in the antenna 1 illustrated in FIGS. 4 to 6. This configuration allows the first antenna electrode 11 to also be electrically powered via the third antenna electrode 13 despite that the first antenna electrode 11 is not adjacent to the first probe electrode 31 to the fourth probe electrode 34 in the stacking direction. Likewise, the second antenna electrode 12 may be coupled to the fourth antenna electrode 14 that is adjacent to the first probe electrode 31 to the fourth probe electrode 34 in the stacking direction. This configuration allows the second antenna electrode 12 to also be electrically powered via the fourth antenna electrode 14 despite that the second antenna electrode 12 is not adjacent to the first probe electrode 31 to the fourth probe electrode 34 in the stacking direction.

In an alternative embodiment, the probe layer 51 may be provided between the first antenna layer 21 and the second antenna layer 22.

The first probe electrode 31 to the fourth probe electrode 34 of the antenna 1E may each have an asymmetric shape, such as an L-shape, when seen in plan view along the stacking direction. In the example illustrated in FIG. 20, the first probe electrode 31 and the second probe electrode 32 may each have a shape asymmetric to the second symmetry plane, and the third probe electrode 33 and the fourth probe electrode 34 may each have a shape asymmetric to the first symmetry plane when seen in plan view along the stacking direction.

Additionally, the first probe electrode 31 and the second probe electrode 32 of the antenna 1E may be mirror symmetrical to the first symmetry plane perpendicular to the X-Y plane. The first symmetry plane may extend through the central portions of the first antenna electrode 11 to the fourth antenna electrode 14 when seen in plan view along the stacking direction, and may be parallel to the X-Z plane.

Additionally, the third probe electrode 33 and the fourth probe electrode 34 of the antenna 1E may be mirror symmetric about the second symmetry plane perpendicular to the X-Y plane. The second symmetry plane may extend through the central portions of the first antenna electrode 11 to the fourth antenna electrode 14 when seen in plan view along the stacking direction, and may be parallel to the Y-Z plane.

The radiation pattern of the antenna 1E having such a configuration is symmetrical and well-balanced compared with that of the antenna 1B according to the second modification example illustrated in FIGS. 14 and 15. This is attributed to the first probe electrode 31 mirror symmetrical to the second probe electrode 32 and the third probe electrode 33 mirror symmetrical to the fourth probe electrode 34.

Other configurations and operations of the antenna 1E may be substantially similar to those of the antenna 1C according to the third modification example of the first embodiment.

Sixth Modification Example

Figure 24:
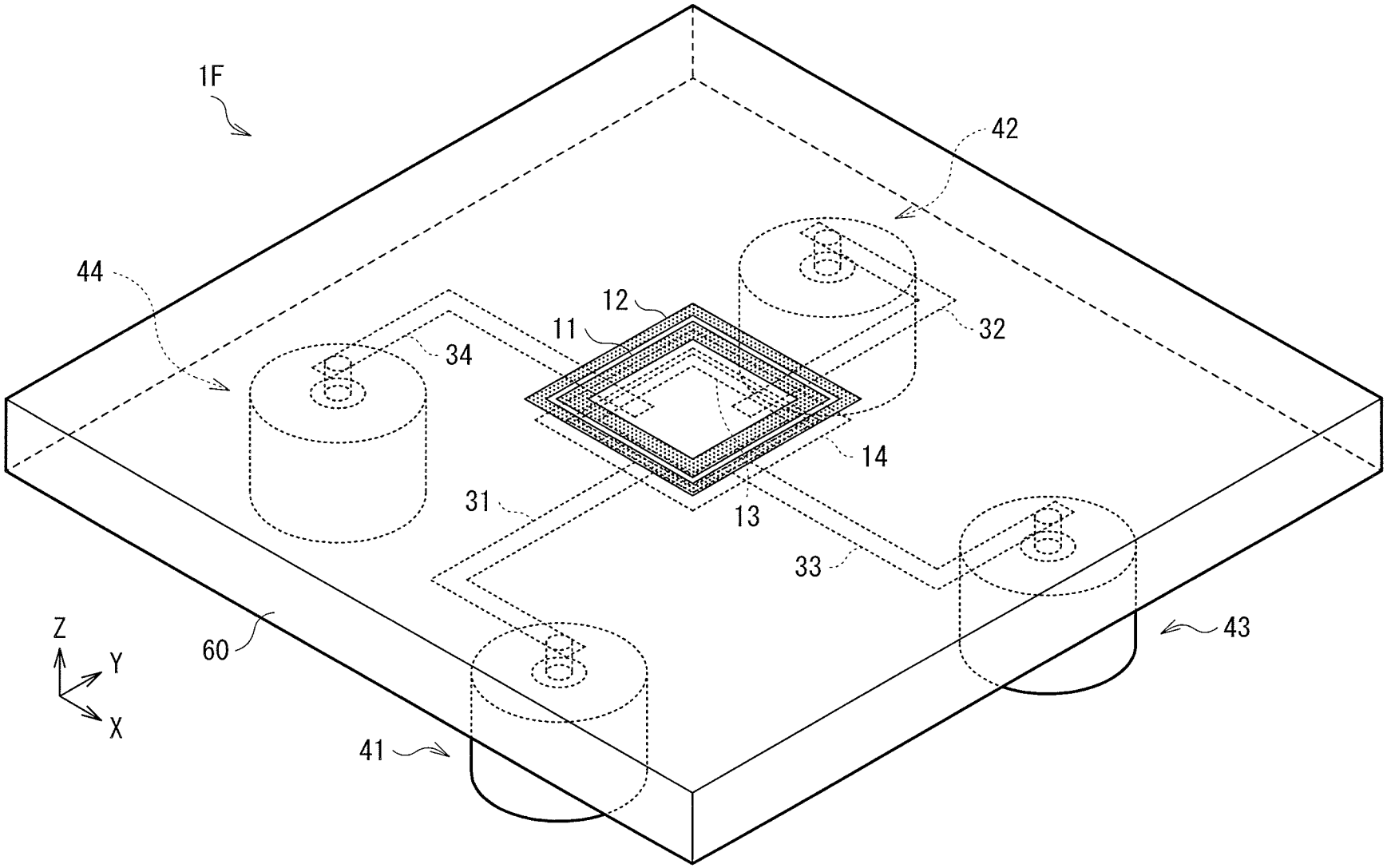
FIG. 24 is a perspective view of an antenna according to a sixth modification example of one embodiment.

FIG. 24 illustrates an example perspective configuration of an antenna 1F according to a sixth modification example of the first embodiment. The antenna 1F may have a first cross-section and a second cross-section that are substantially similar to those illustrated in FIGS. 21 and 22.

Like the antenna 1E according to the fifth modification example illustrated in FIGS. 20 to 22, the antenna 1F according to the sixth modification example may include the first probe electrode 31 to the fourth probe electrode 34 and the first power-feed connector 41 to the fourth power-feed connector 44. The first probe electrode 31 and the second probe electrode 32 may be excited differentially with each other. Additionally, the third probe electrode 33 and the fourth probe electrode 34 may be excited differentially with each other.

The antenna 1F according to the sixth modification example may be different from the antenna 1E according to the fifth modification example in the geometry of the first probe electrode 31 to the fourth probe electrode 34.

The first probe electrode 31 and the second probe electrode 32 in the antenna 1F may have rotational symmetry of 180 degrees about a rotation axis perpendicular to the X-Y plane, as in the antenna 1D according to the fourth modification example illustrated in FIG. 18. Likewise, the third probe electrode 33 and the fourth probe electrode 34 may have rotational symmetry of 180 degrees about the rotation axis perpendicular to the X-Y plane. The rotation axis may extend through central portions of the first antenna electrode 11 to the fourth antenna electrode 14 when seen in plan view along the stacking direction, and may be parallel to the Z-axis.

The radiation pattern of the antenna 1F having such a configuration is symmetrical and well-balanced compared with that of the antenna 1B according to the second modification example illustrated in FIGS. 14 and 15. This is attributed to the first probe electrode 31 having rotational symmetry of 180 degrees with respect to the second probe electrode 32 and the third probe electrode 33 having rotational symmetry of 180 degrees with respect to the fourth probe electrode 34.

Other configurations and operations of the antenna 1F may be substantially similar to those of the antenna 1D according to the fourth modification example of the first embodiment or the antenna 1E according to the fifth modification example of the first embodiment.

Other Modification Examples of First Embodiment

In the first embodiment, the first antenna layer 21 and the second antenna layer 22 may each be provided with two annular antenna electrodes, thereby forming two pairs of antenna electrodes. However, the number of the antenna layers is not limited to two. In a modification example of the first embodiment, one or more antenna layers may be added above or below the first antenna layer 21 or the second antenna layer 22, and the three or more antenna layers may be each provided with two annular antenna electrodes. Three or more of the antenna electrodes overlapping in the stacking direction may be coupled to each other to form a single set of antenna electrodes, thereby forming two sets of antenna electrodes each including three or more antenna electrodes. Each of the sets including the three or more antenna electrodes that are coupled to each other may generate a single frequency band.

2. SECOND EMBODIMENT (EXAMPLE CONFIGURATION OF ANTENNA HAVING THREE OR MORE ANTENNA ELECTRODES ON ONE PLANE

An antenna 2 according to a second embodiment of the disclosure will now be described. In the following description, components substantially the same as those in the antenna 1 according to the first embodiment are assigned with the same reference numerals without redundant description thereof.

FIG. 25 illustrates an example planar configuration of the second antenna layer 22 of the antenna 2 according to the second embodiment of the disclosure. FIG. 26 illustrates an example planar configuration of the first antenna layer 21 of antenna 2. FIG. 27 illustrates an example cross-sectional configuration of the antenna 2. FIG. 27 is an example cross-sectional view of the antenna 2 taken along the line A-A' of FIG. 26.

The antenna 2 according to the second embodiment may further include a fifth antenna electrode 15 and a sixth antenna electrode 16 in addition to the components of the antenna 1 according to the first embodiment illustrated in FIGS. 4 to 6. The fifth antenna electrode 15 and the sixth antenna electrode 16 may each have an annular conductor pattern.

The fifth antenna electrode 15 may be different in size from the first antenna electrode 11 and the second antenna electrode 12. The fifth antenna electrode 15 may be disposed on the second antenna layer 22 together with the first antenna electrode 11 and the second antenna electrode 12. The fifth antenna electrode 15 may have an annular shape. For example, the fifth antenna electrode 15 may be larger in size than the first antenna electrode 11 and the second antenna electrode 12 and disposed outside the first antenna electrode 11 and the second antenna electrode 12.

The sixth antenna electrode 16 may be different in size from the third antenna electrode 13 and the fourth antenna electrode 14. The sixth antenna electrode may be disposed on the first antenna layer 21 together with the third antenna electrode 13 and the fourth antenna electrode 14. The sixth antenna electrode may have an annular shape. For example, the sixth antenna electrode 16 may be larger in size than the third antenna electrode 13 and the fourth antenna electrode 14 and disposed outside the third antenna electrode 13 and the fourth antenna electrode 14.

For example, the fifth antenna electrode 15 may be the largest antenna electrode in the antenna 2. The first antenna electrode 11 to the fourth antenna electrode 14 and the sixth antenna electrode 16 may be disposed inward from, for example, the outer periphery of the fifth antenna electrode 15 when seen in plan view along the stacking direction.

The first antenna electrode 11 to the sixth antenna electrode 16 may be electrically powered via the first power-feed connector 41 and the first probe electrode 31.

In the antenna 2, the first probe electrode 31 overlaps one or both of the first antenna electrode 11 and the third antenna electrode 13, one or both of the second antenna electrode 12 and the fourth antenna electrode 14, and one or both of the fifth antenna electrode 15 and the sixth antenna electrode 16 when seen in plan view along the stacking direction. This configuration allows the first antenna electrode 11 to the sixth antenna electrode 16 to be electrically powered via the first probe electrode 31. In the example configuration illustrated in FIGS. 25 to 27, the first probe electrode 31 overlap all of the first antenna electrode 11 to the sixth antenna electrode 16 when seen in plan view along the stacking direction.

In the antenna 2, the first probe electrode 31 may be disposed directly adjacent to the first antenna layer 21 in the stacking direction. The first probe electrode 31 overlaps the third antenna electrode 13, the fourth antenna electrode 14, and the sixth antenna electrode 16 that are disposed on the first antenna layer 21 when seen in plan view along the stacking direction. This configuration allows the pair of the first antenna electrode 11 and the third antenna electrode 13, the pair of the second antenna electrode 12 and the fourth antenna electrode 14, and the pair of the fifth antenna electrode 15 and the sixth antenna electrode 16 to be electrically powered via the first power-feed connector 41 and the first probe electrode 31. In the antenna 2, the first antenna electrode 11 may be coupled to the third antenna electrode 13 that is adjacent to the first probe electrode 31 in the stacking direction, as in the antenna 1 illustrated in FIGS. 4 to 6. This configuration allows the first antenna electrode 11 to also be electrically powered via the third antenna electrode 13 despite that the first antenna electrode 11 is not adjacent to the first probe electrode 31 in the stacking direction. Likewise, the second antenna electrode 12 may be coupled to the fourth antenna electrode 14 that is adjacent to the first probe electrode 31 in the stacking direction. This configuration allows the second antenna electrode 12 to also be electrically powered via the fourth antenna electrode 14 despite that the second antenna electrode 12 is not adjacent to the first probe electrode 31 in the stacking direction. Further, the fifth antenna electrode 15 may be coupled to the sixth antenna electrode 16 that is adjacent to the first probe electrode 31 in the stacking direction. This configuration allows the fifth antenna electrode 15 to also be electrically powered via the sixth antenna electrode 16 despite that the fifth antenna electrode 15 is not adjacent to the first probe electrode 31 in the stacking direction.

In an alternative embodiment, the probe layer 51 may be provided between the first antenna layer 21 and the second antenna layer 22.

When the first antenna electrode 11 to the sixth antenna electrode 16 are electrically powered via the first probe electrode 31 in the antenna 2, an electric current may flow in each of the antenna electrodes to cause each of the antenna electrodes to occur specific resonance based on the current path. The second antenna electrode 12 and the fourth antenna electrode 14 that are coupled and paired to each other may thus serve as an antenna operating in a frequency band centered on a first frequency fa. Additionally, the first antenna electrode 11 and the third antenna electrode 13 that are coupled and paired to each other may serve as an antenna operating in a frequency band centered on a second frequency fb. The fifth antenna electrode 15 and the sixth antenna electrode 16 that are coupled and paired to each other may serve as an antenna operating in a frequency band centered on a third frequency fc.

In the antenna 2, the fifth antenna electrode 15 and the sixth antenna electrode 16 may each have a round-trip length larger than those of the first antenna electrode 11 to the fourth antenna electrode 14. Additionally, the third frequency fc may be lower than the first frequency fa which is lower than the second frequency fb (fb>fa>fc). The antenna 2 having such a configuration may operate in three modes having different band frequencies.

Example dimensions and other parameters of portions of the antenna 2 illustrated in FIGS. 25 to 27 are as follows:

Wx=8.0, Wy=8.0, a=b=1.84, c=d=1.40, i=j=2.3, e=f=2.00, g=h=1.60, m=n=2.40, $w_1$=0.17, $w_2$=0.18, $w_3$=0.15, $w_4$=0.21, $w_5$=0.15, $w_6$=0.13, $s_1$=0.05, $s_2$=0.06, $P_w$=0.2, $P_s$=0.92, $P_1$=1.59, D=0.1, $t_1$=0.4, $t_2$=0.1, $t_3$=0.2, εr=2.9 where "εr" denotes a relative dielectric constant of the dielectric 60, and the reference characters other than "εr" denote respective dimensions in unit of millimeter [mm].

Other configurations and operations of the antenna 2 may be substantially similar to those of the antenna 1 according to the first embodiment.

Modification Example of Second Embodiment

In the antenna 2, the first antenna layer 21 and the second antenna layer 22 may each be provided with three antenna electrodes each having an annular shape, thereby forming three pairs of antenna electrodes. However, the number of the antenna electrodes disposed on each antenna layer is not limited to three. In other words, the number of pairs of the antenna electrodes disposed in the antenna 2 is not limited to three. In another modification example, the first antenna layer 21 and the second antenna layer 22 may each be provided with four or more antenna electrodes each having an annular shape, thereby forming four or more pairs of the antenna electrodes. This configuration allows the antenna 2 to have four or more frequency bands.

In another modification example of the second embodiment, the antenna 2 may further include the second probe electrode 32 as in the first modification example of the first embodiment illustrated in FIGS. 10 to 13. Alternatively, the antenna 2 may further include the second probe electrode 32 that is excited differentially with the first probe electrode 31, as in the third modification example of the first embodiment illustrated in FIG. 16. Optionally, the antenna 2 may further include the third probe electrode 33 and the fourth probe electrode 34 that are excited differentially with each other, as in the modification example of the first embodiment illustrated in FIGS. 20 to 23 and FIG. 24, for example. Additionally, each of the probe electrodes may have an asymmetric shape, such as an L-shape, when seen in plan view along the stacking direction.

3. THIRD EMBODIMENT (EXAMPLE CONFIGURATION OF ANTENNA HAVING THREE-LAYERED STRUCTURE

An antenna 3 according to a third embodiment of the disclosure will now be described. In the following description, components substantially the same as those in the antenna according to the first and second embodiments are assigned with the same reference numerals without redundant description thereof.

3.1 Example Configuration of Antenna of Third Embodiment

Figure 28:
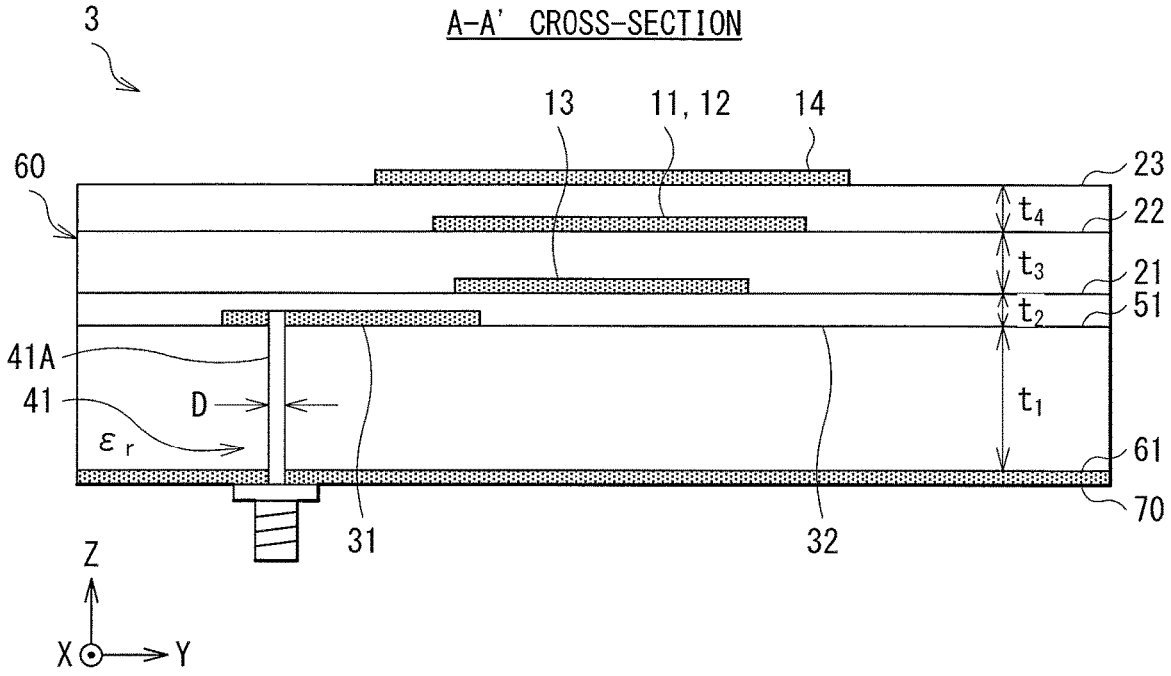
FIG. 28 is a cross-sectional view of an antenna according to one embodiment.
Figure 29:
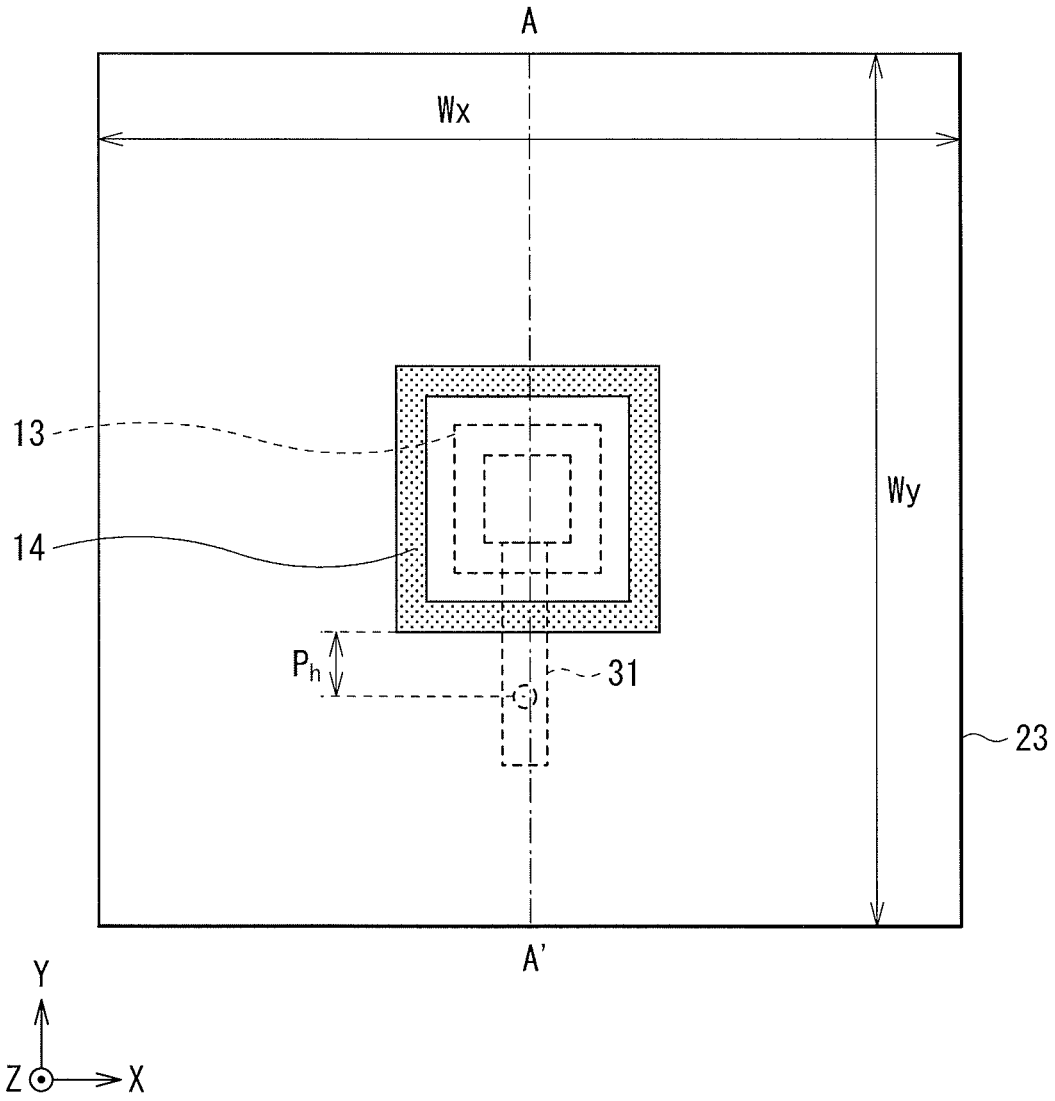
FIG. 29 is a plan view of the antenna according to one embodiment when viewed in a stacking direction.
Figure 30A:
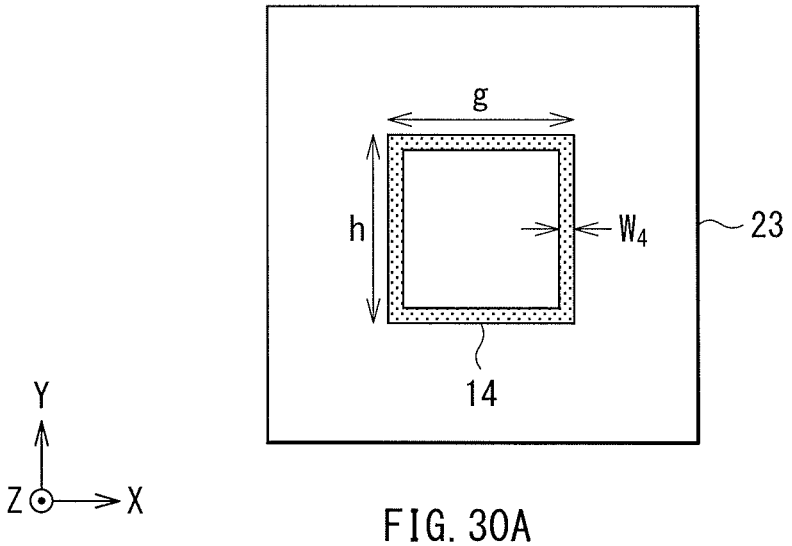
FIG. 30A is a plan view of a third antenna layer of the antenna according to one embodiment.
Figure 30B:
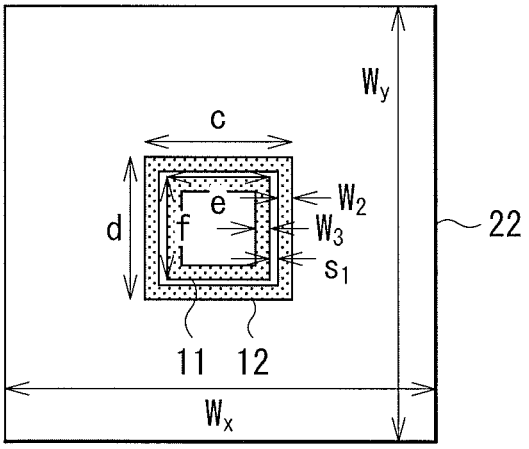
FIG. 30B is a plan view of a second antenna layer of the antenna according to one embodiment.
Figure 30C:
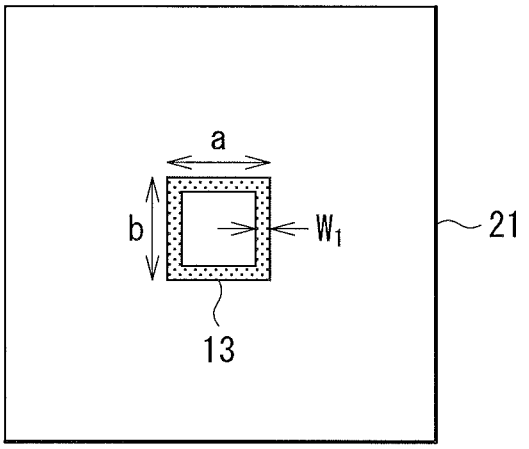
FIG. 30C is a plan view of a first antenna layer of the antenna according to one embodiment.
Figure 31:
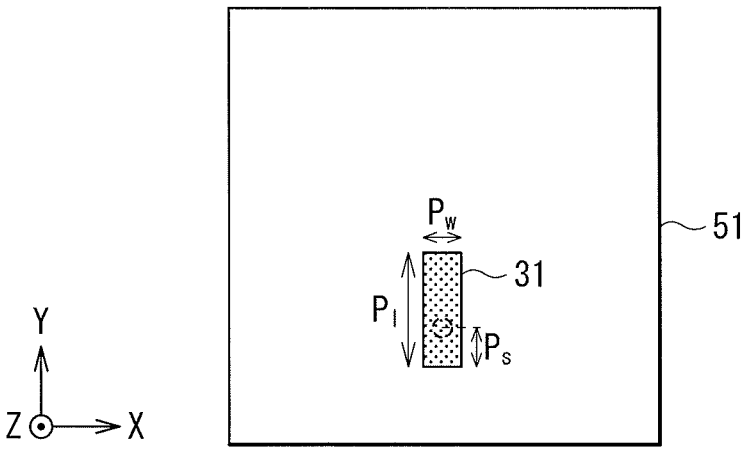
FIG. 31 is a plan view of a probe layer of the antenna according to one embodiment.

FIG. 28 illustrates an example cross-sectional configuration of the antenna 3 according to the third embodiment. FIG. 29 illustrates an example planar configuration of the antenna 3 when viewed in the stacking direction. FIGS. 30A, 30B, and 30C respectively illustrate example planar configurations of a third antenna layer 23, the second antenna layer 22, and the first antenna layer 21. FIG. 31 illustrates an example planar configuration of the probe layer 51 of the antenna 3. FIG. 28 is a cross-sectional view of the antenna 3 taken along the line A-A' in FIG. 29.

The antenna 3 according to the third embodiment may further include the third antenna layer 23 in addition to the components of the antenna 1 according to the first embodiment illustrated in FIGS. 4 to 6.

The antenna 3 may include the ground layer 70, the probe layer 51, the first antenna layer 21, the second antenna layer 22, and the third antenna layer 23 that are laminated in this order from the bottom surface 61 of the dielectric 60.

The second antenna layer 22 of the antenna 3 may correspond to a specific but non-limiting example of the first plane and the second plane according to one embodiment of the disclosure. In other words, the second antenna layer 22 may correspond to a specific but non-limiting example of the first face according to one embodiment of the disclosure in a case where the first plane and the second plane are on the same plane. The first antenna layer 21 may correspond to a specific but non-limiting example of the third plane according to one embodiment of the disclosure. The third antenna layer 23 may correspond to a specific but non-limiting example of the fourth plane according to one embodiment of the disclosure. The probe layer 51 may correspond to a specific but non-limiting example of the fifth plane according to one embodiment of the disclosure.

The first antenna electrode 11 and the second antenna electrode 12 are disposed on the second antenna layer 22. The first antenna electrode 11 and the second antenna electrode 12 each have an annular shape and are different in size from each other. The second antenna electrode 12 may be larger in size than the first antenna electrode 11 and disposed outside the first antenna electrode 11.

The third antenna electrode 13 having an annular shape is disposed on the first antenna layer 21.

The fourth antenna electrode 14 having an annular shape is disposed on the third antenna layer 23. The fourth antenna electrode 14 may be larger in size than the third antenna electrode 13 and disposed outside the third antenna electrode 13 when seen in plan view along the stacking direction.

The first antenna electrode 11 to the fourth antenna electrode 14 include the largest antenna electrode having an outer periphery and disposed most outside among the first to the fourth antenna electrodes, and the remaining antenna electrodes other than the largest antenna electrode among the first to the fourth antenna electrodes are disposed inward from the outer periphery of the largest antenna electrode when seen in plan view along the stacking direction.

In the antenna 3, the fourth antenna electrode 14 may be the largest antenna electrode, the second antenna electrode 12 may be the second largest antenna electrode, the first antenna electrode 11 may be the third largest antenna electrode, and the third antenna electrode 13 may be the smallest antenna electrode, for example.

When the first antenna electrode 11 to the fourth antenna electrode 14 are electrically powered via the first probe electrode 31 in the antenna 3, an electric current may flow in each of the antenna electrodes to cause each of the antenna electrodes to occur specific resonance based on the current path, as in the antenna 1 according to the first embodiment. The second antenna electrode 12 and the fourth antenna electrode 14 that are coupled and paired to each other may thus serve as an antenna operating in a frequency band centered on the first frequency fa. Additionally, the first antenna electrode 11 and the third antenna electrode 13 that are coupled and paired to each other may serve as an antenna operating in a frequency band centered on a second frequency fb.

In the antenna 3, the first antenna electrode 11 and the third antenna electrode 13 may each have a round-trip length smaller than those of the second antenna electrode 12 and the fourth antenna electrode 14, and the second frequency fb may be higher than the first frequency fa (fb>fa), as in the antenna 1 according to the first embodiment.

In the antenna 3, a specific resonance frequency f1 of the first antenna electrode 11, a specific resonance frequency f2 of the second antenna electrode 12, a specific resonance frequency f3 of the third antenna electrode 13, and a specific resonance frequency f4 of the fourth antenna electrode 14 may satisfy, for example, all of Expressions 1 to 8 described above, as in the antenna 1 according to the first embodiment. This makes it possible to widen the bandwidth in each operation mode.

Example dimensions and other parameters of portions of the antenna 3 illustrated in in FIGS. 28 to 31 are as follows:

Wx=8.0, Wy=8.0, a=b=1.30, c=d=1.80, e=f=1.40, g=h=2.00, $w_1$=0.20, $w_2$=0.15, $w_3$=0.15, $w_4$=0.20, $s_1$=0.05, Ph=0.5, $P_w$=0.40, $P_s$=0.62, $P_1$=1.67, D=0.1, $t_1$=0.8, $t_2$=0.1, $t_3$=0.3, $t_4$=0.1, εr=2.9 where "εr" denotes a relative dielectric constant of the dielectric 60, and the reference characters other than "εr" denote respective dimensions in unit of millimeter [mm].

[Antenna Characteristics]

Described below are results of a simulation of various antenna characteristics of the antenna 3. In the simulation, dimensions and other parameters of portions of the antenna 3 illustrated in FIGS. 28 to 31 were as described above.

Figure 32:
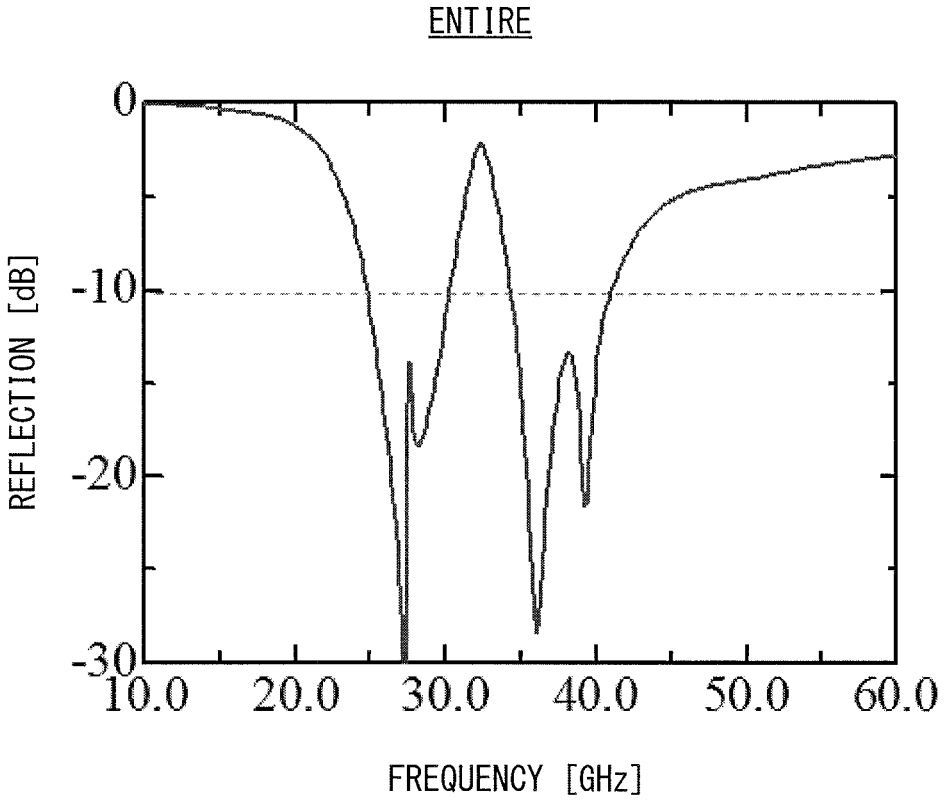
FIG. 32 is a diagram illustrating the entire reflectance of the antenna according to one embodiment.
Figure 33:
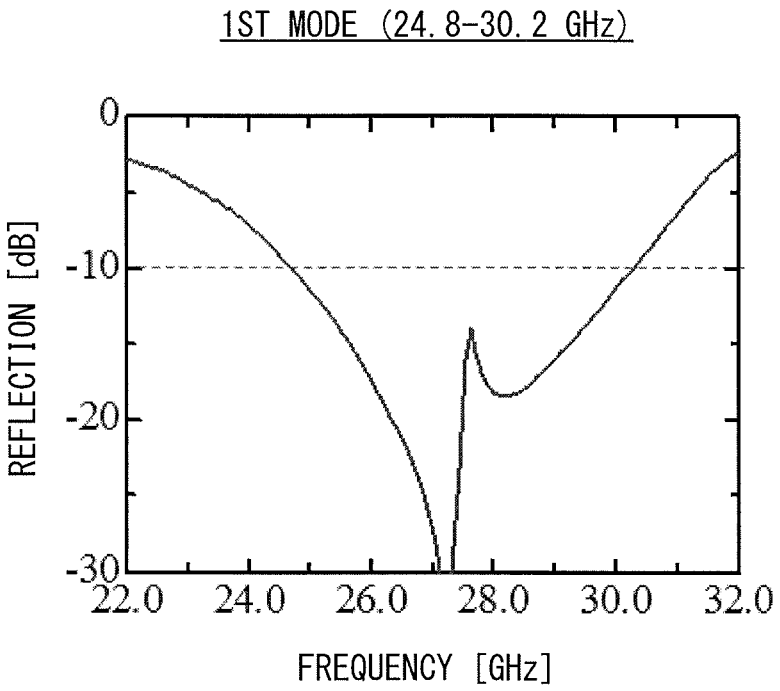
FIG. 33 is an enlarged diagram illustrating a reflectance in a first mode of the antenna according to one embodiment.
Figure 34:
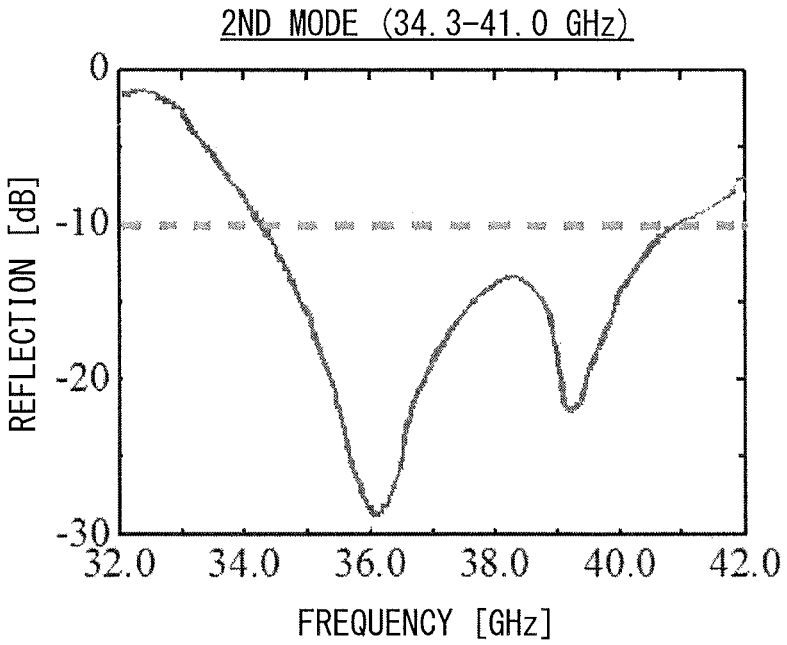
FIG. 34 is an enlarged diagram illustrating a reflectance in a second mode of the antenna according to one embodiment.

FIG. 32 illustrates the result of a simulation of the entire reflectance of the antenna 3. FIG. 33 illustrates the reflectance of the antenna 3 in the first mode in an enlarged manner. FIG. 34 illustrates the reflectance of the antenna 3 in the second mode in an enlarged manner.

FIGS. 32 to 34 demonstrate that a broad frequency band was achieved in each operation mode.

Other configurations and operations of the antenna 3 may be substantially similar to those of the antenna 1 according to the first embodiment.

3.2 Modification Example of Third Embodiment

Figure 35:
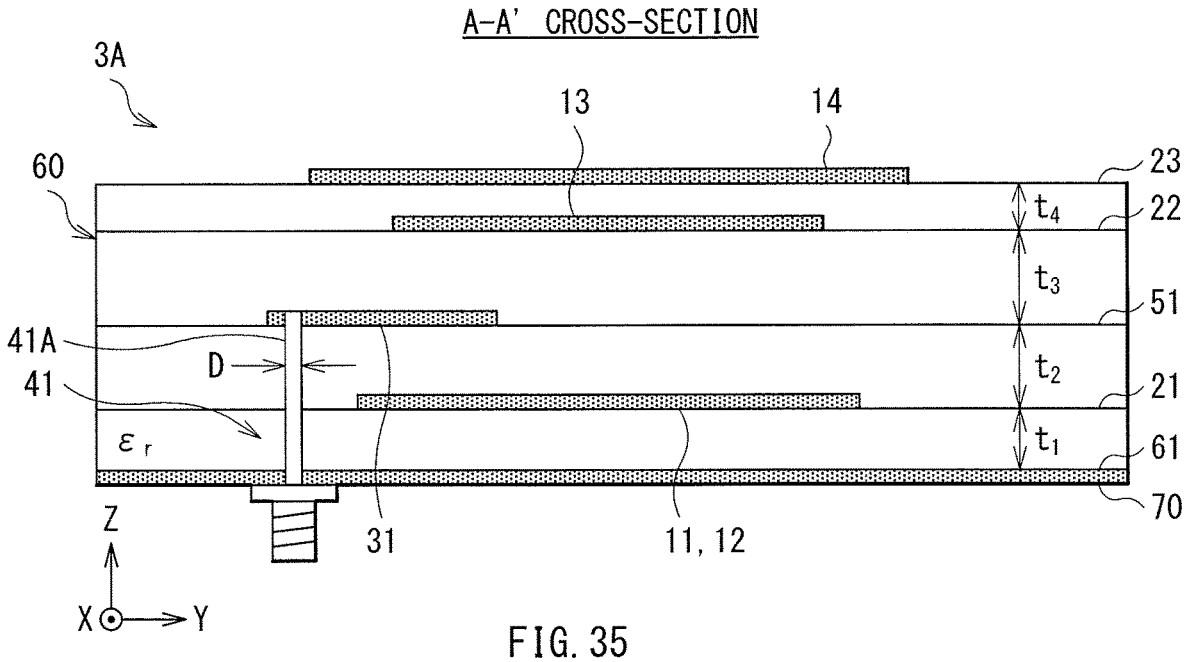
FIG. 35 is a cross-sectional view of an antenna according to a modification example of one embodiment.
Figure 36:
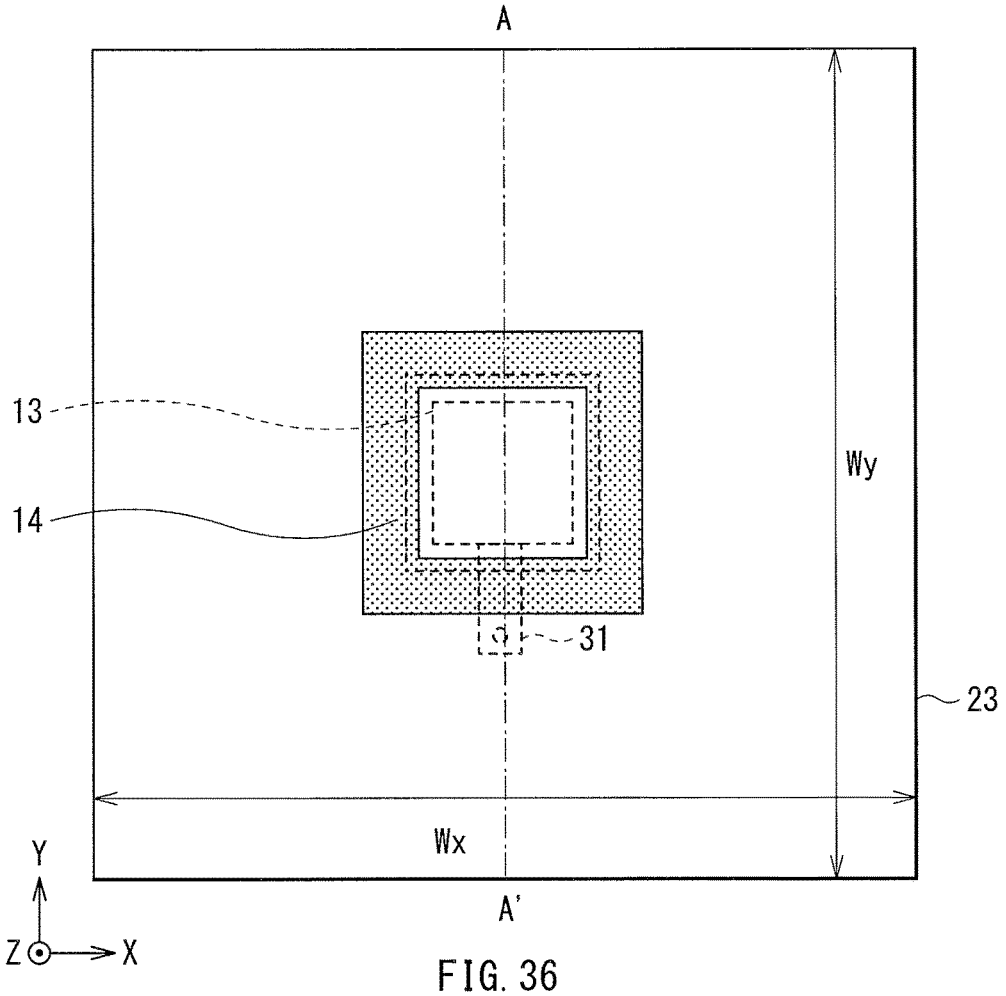
FIG. 36 is a plan view of the antenna according to the modification example of one embodiment when viewed in the stacking direction.
Figure 37A:
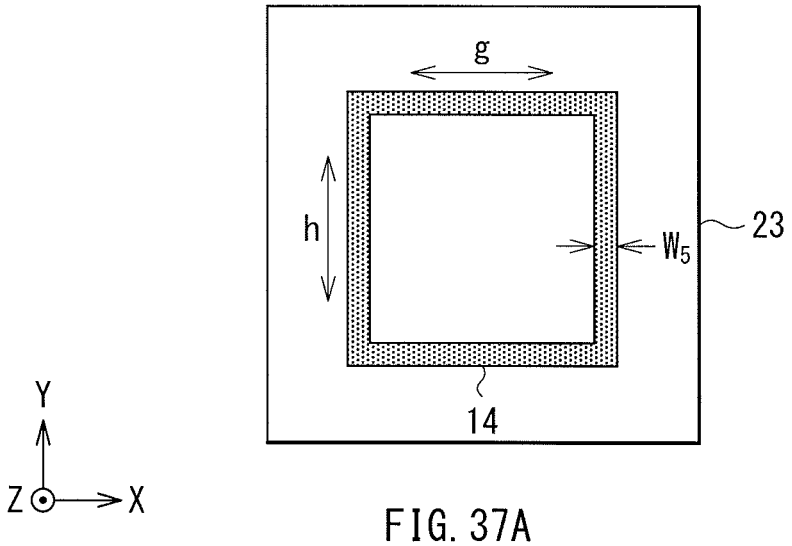
FIG. 37A is a plan view of a third antenna layer of the antenna according to the modification example of one embodiment.
Figure 37B:
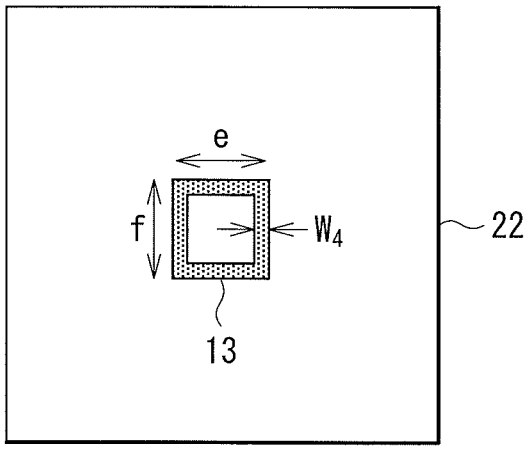
FIG. 37B is a plan view of a second antenna layer of the antenna according to the modification example of one embodiment.
Figure 37C:
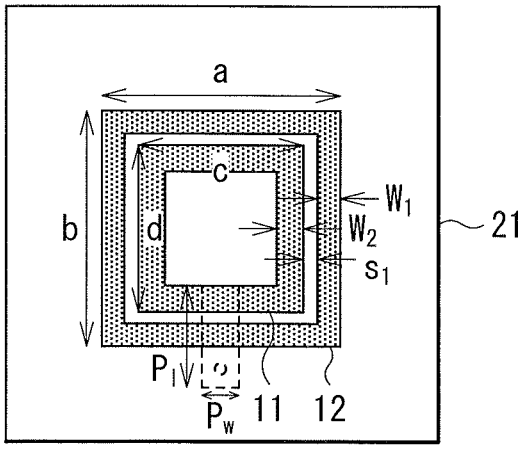
FIG. 37C is a plan view of a first antenna layer of the antenna according to the modification example of one embodiment.
Figure 38:
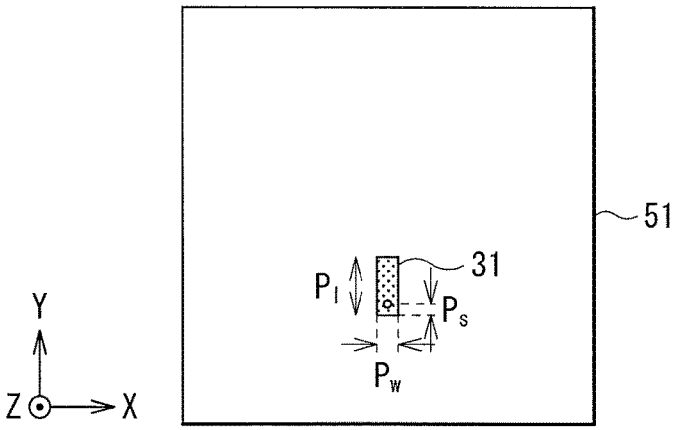
FIG. 38 is a plan view of a probe layer of the antenna according to the modification example of one embodiment.

FIG. 35 illustrates an example cross-sectional configuration of an antenna 3A according to a modification example of the third embodiment of the disclosure. FIG. 36 illustrates an example planar configuration of the antenna 3A when viewed in the stacking direction. FIGS. 37A, 37B, and 37C respectively illustrate example planar configurations of the third antenna layer 23, the second antenna layer 22, and the first antenna layer 21. FIG. 38 illustrates an example planar configuration of the probe layer 51 of the antenna 3A. FIG. 35 is a cross-sectional view of the antenna 3A taken along the line A-A' in FIG. 35.

The antenna 3A may be different from the antenna 3 illustrated in FIGS. 28 to 31 in the position of the probe layer 51. The antenna 3A may include the ground layer 70, the first antenna layer 21, the probe layer 51, the second antenna layer 22, and the third antenna layer 23 that are laminated in this order from the bottom surface 61 of the dielectric 60.

The first antenna layer 21 of the antenna 3A may correspond to a specific but non-limiting example of the first plane and the second plane according to one embodiment of the disclosure. In other words, the first antenna layer 21 may correspond to a specific but non-limiting example of the first face according to one embodiment of the disclosure in a case where the first plane and the second plane are on the same plane. The second antenna layer 22 may correspond to a specific but non-limiting example of the third plane according to one embodiment of the disclosure. The third antenna layer 23 may correspond to a specific but non-limiting example of the fourth plane according to one embodiment of the disclosure. The probe layer 51 may correspond to a specific but non-limiting example of the fifth plane according to one embodiment of the disclosure.

The first antenna electrode 11 and the second antenna electrode 12 are disposed on the first antenna layer 21 in the antenna 3A. The first antenna electrode 11 and the second antenna electrode 12 each have an annular shape and are different in size from each other. The second antenna electrode 12 may be larger in size than the first antenna electrode 11 and disposed outside the first antenna electrode 11.

Additionally, the third antenna electrode 13 having an annular shape is disposed on the second antenna layer 22 in the antenna 3A.

Further, the fourth antenna electrode 14 having an annular shape is disposed on the third antenna layer 23 in the antenna 3A. The fourth antenna electrode 14 may be larger in size than the third antenna electrode 13 and disposed outside the third antenna electrode 13 when seen in plan view along the stacking direction.

In the antenna 3A, the first through-conductor 41A of the first power-feed connector 41 may extend through the ground layer 70 and the bottom surface 61 to the first probe electrode 31 of the dielectric 60. The first antenna electrode 11 to the fourth antenna electrode 14 may be electrically powered via the first power-feed connector 41 and the first probe electrode 31.

When the first antenna electrode 11 to the fourth antenna electrode 14 may be electrically powered via the first probe electrode 31 in the antenna 3A, an electric current may flow in each of the antenna electrodes to cause each of the antenna electrodes to occur specific resonance based on the current path, as in the antenna 1 according to the first embodiment. The second antenna electrode 12 and the fourth antenna electrode 14 that are coupled and paired to each other may thus serve as an antenna operating in a frequency band centered on a first frequency fa. Additionally, the first antenna electrode 11 and the third antenna electrode 13 that are coupled and paired to each other may serve as an antenna operating in a frequency band centered on a second frequency fb.

In the antenna 3A, the first probe electrode 31 may be disposed directly adjacent to one or both of the first antenna electrode 11 and the third antenna electrode 13, and one or both of the second antenna electrode 12 and the fourth antenna electrode 14, for example. In the present embodiment, the first probe electrode 31 may be disposed directly adjacent to the second antenna electrode 12 and both of the first antenna electrode 11 and the third antenna electrode 13. The fourth antenna electrode 14 may be coupled to the second antenna electrode 12 that is adjacent to the first probe electrode 31 in the stacking direction in the antenna 3A. This configuration allows the fourth antenna electrode 14 to also be electrically powered via the second antenna electrode 12 despite that the fourth antenna electrode 14 is not adjacent to the first probe electrode 31 in the stacking direction.

Example dimensions and other parameters of portions of the antenna 3A illustrated in FIGS. 35 to 38 are as follows:

$Wx=8.0$, $Wy=8.0$, $a=b=1.84$, $c=d=1.52$, $e=f=1.40$, $g=h=2.00$, $w_1=0.20$, $w_2=0.24$, $w_4=0.32$, $w_5=0.40$, $s_1=0.05$, $P_w=0.30$, $P_s=0.20$, $P_1=0.98$, $D=0.15$, $t_1=0.3$, $t_2=0.4$, $t_3=0.4$, $t_4=0.2$, $\varepsilon r=2.9$ where "εr" denotes a relative dielectric constant of the dielectric 60, and the reference characters other than "εr" denote respective dimensions in unit of millimeter [mm].

Other configurations and operations of the antenna 3A may be substantially similar to those of the antenna 1 according to the first embodiment and those of the antenna 3 according to the third embodiment.

Modification Example of Third Embodiment

Two pairs of the antenna electrodes may be provided in the antennas 3 and 3A. However, the number of the pairs of the antenna electrode is not limited to two. In a modification example of the third embodiment, the fifth antenna electrode 15 and the sixth antenna electrode 16 may be respectively added to any two of the first to third antenna layers 21 to 23, and three or more pairs of the antenna electrodes may be formed to generate three or more frequency bands, as in the antenna 2 according to the second embodiment illustrated in FIGS. 25 to 27. Optionally, two or more antenna electrodes may be further added, and four or more pairs of the antenna electrodes may be formed to generate four or more frequency bands.

In an alternative embodiment, the probe layer 51 may be provided between the second antenna layer 22 and the third antenna layer 23.

In another modification example of the third embodiment, the antenna 3 or 3A may further include the second probe electrode 32, as in the first modification example of the first embodiment illustrated FIGS. 10 to 13. Alternatively, the antenna 3 or 3A may further include the second probe electrode 32 that is excited differentially with the first probe electrode 31, as in the third modification example of the first embodiment illustrated in FIG. 16. Optionally, the antenna 3 or 3A may further include the third probe electrode 33 and the fourth probe electrode 34 that are excited differentially with each other, as in the modification example of the first embodiment illustrated in FIGS. 20 to 23 and FIG. 24, for example. Additionally, each of the probe electrodes may have an asymmetric shape, such as an L-shape, when seen in plan view along the stacking direction. Like the first probe electrode 31, the second probe electrode 32 to the fourth probe electrode 34 may be disposed directly adjacent to one or both of the first antenna electrode 11 and the third antenna electrode 13, and one or both of the second antenna electrode 12 and the fourth antenna electrode 14, for example.

4. FOURTH EMBODIMENT (EXAMPLE CONFIGURATION OF ANTENNA INCLUDING ANTENNA ELECTRODE HAVING FOUR-LAYERED STRUCTURE)

An antenna 4 according to a fourth embodiment of the disclosure will now be described. In the following description, components substantially the same as those in the antenna according to the first to third embodiments are assigned with the same reference numerals without redundant description thereof.

4.1 Example Configuration of Antenna of Fourth Embodiment

Figure 39:
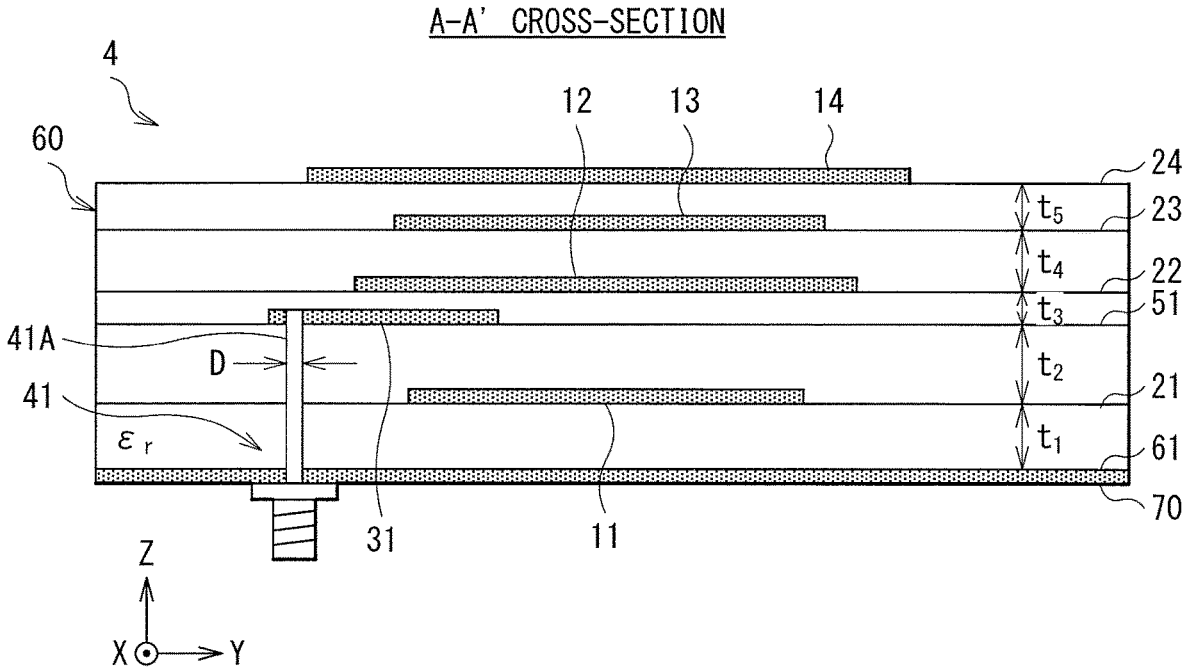
FIG. 39 is a cross-sectional view of an antenna according to one embodiment.
Figure 40:
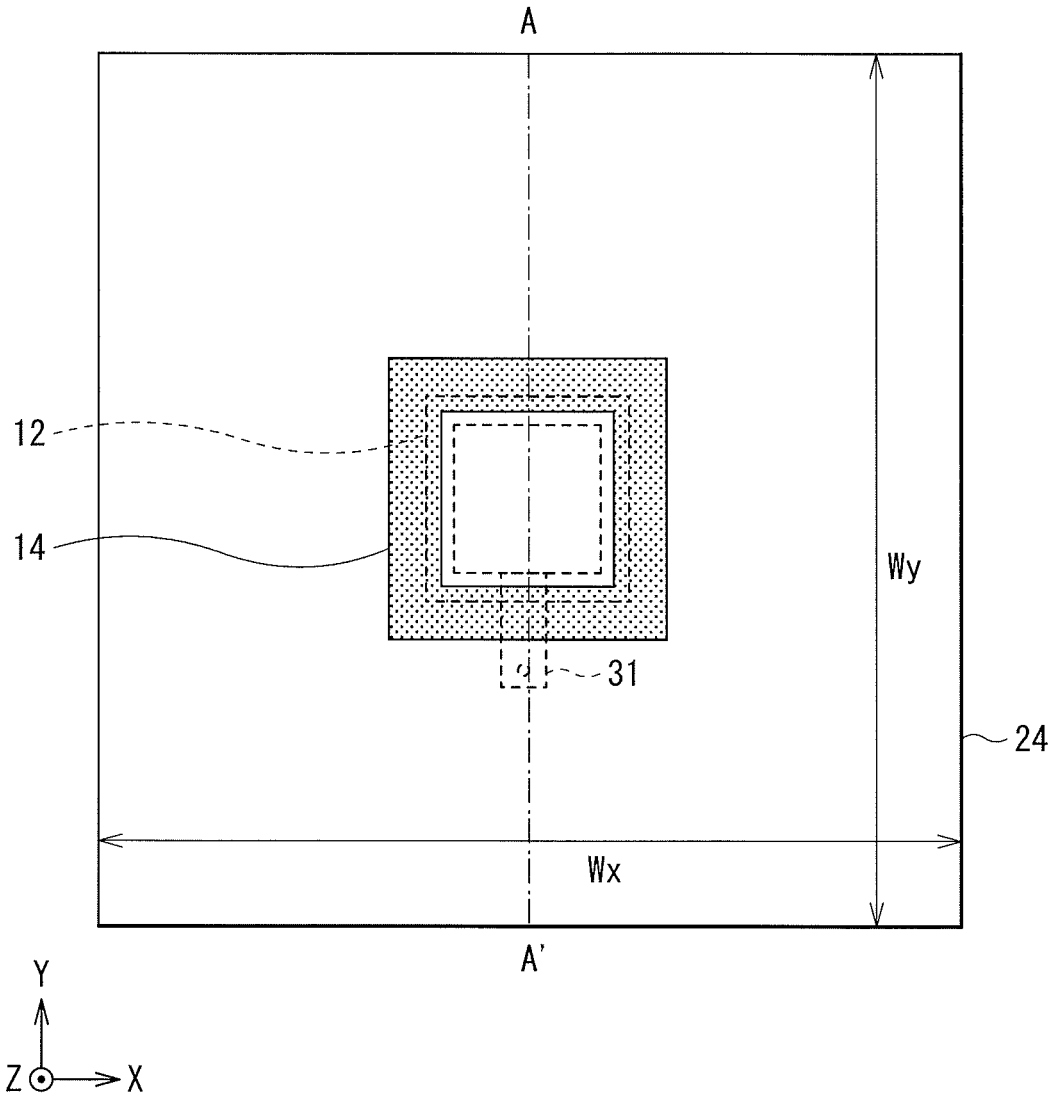
FIG. 40 is a plan view of the antenna according to one embodiment when viewed in the stacking direction.
Figure 41A:
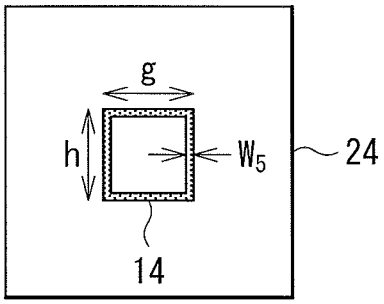
FIG. 41A is a plan view of a fourth antenna layer of the antenna according to one embodiment.
Figure 41A:
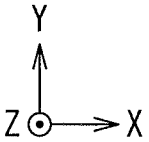
Figure 41B:
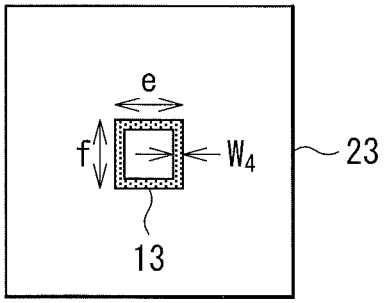
FIG. 41B is a plan view of a third antenna layer of the antenna according to one embodiment.
Figure 41C:
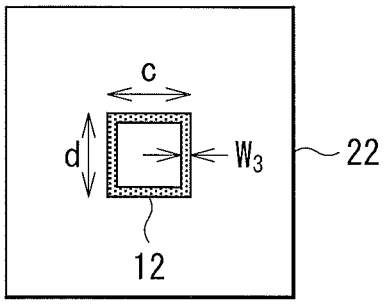
FIG. 41C is a plan view of a second antenna layer of the antenna according to one embodiment.
Figure 41D:
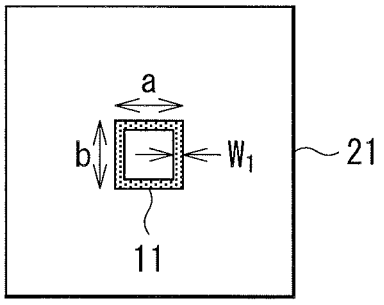
FIG. 41D is a plan view of a first antenna layer of the antenna according to one embodiment.
Figure 42:
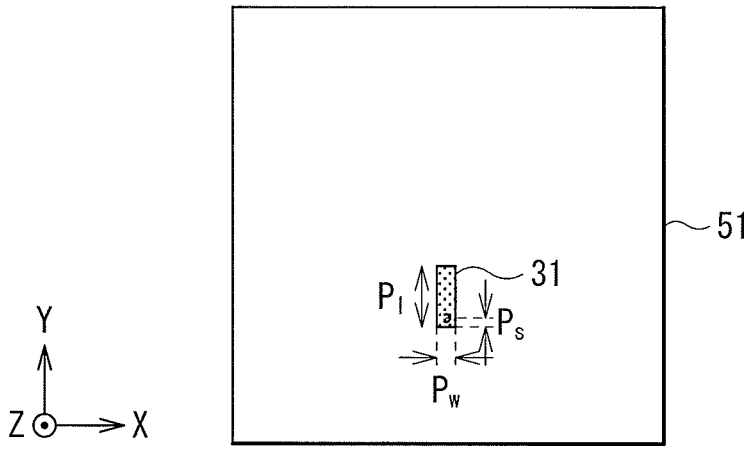
FIG. 42 is a plan view of a probe layer of the antenna according to one embodiment.

FIG. 39 illustrates an example cross-sectional configuration of the antenna 4 according to the fourth embodiment. FIG. 39 illustrates an example planar configuration of the antenna 4 when viewed in the stacking direction. FIG. 40 illustrates an example planar configuration of the antenna 4 when viewed in the stacking direction. FIGS. 41A, 41B, 41C, and 41D respectively illustrate example planar configurations of the fourth antenna layer 24, the third antenna layer 23, the second antenna layer 22, and the first antenna layer 21. FIG. 42 illustrates an example planar configuration of the probe layer 51 of the antenna 4. FIG. 39 is a cross-sectional view of the antenna 4 taken along the line A-A' in FIG. 40.

The antenna 4 according to the fourth embodiment may further include the third antenna layer 23 and the fourth antenna layer 24 in addition to the components of the antenna 1 according to the first embodiment illustrated in FIGS. 4 to 6.

The antenna 4 may include the ground layer 70, the first antenna layer 21, the probe layer 51, the second antenna layer 22, the third antenna layer 23, and the fourth antenna layer 24 that are laminated in this order from the bottom surface 61 of the dielectric 60.

The first antenna layer 21 of the antenna 4 may correspond to a specific but non-limiting example of the first plane according to one embodiment of the disclosure. The second antenna layer 22 may correspond to a specific but non-limiting example of the second plane according to one embodiment of the disclosure. The third antenna layer 23 may correspond to a specific but non-limiting example of the third plane according to one embodiment of the disclosure. The fourth antenna layer 24 may correspond to a specific but non-limiting example of the fourth plane according to one embodiment of the disclosure. The probe layer 51 may correspond to a specific but non-limiting example of the fifth plane according to one embodiment of the disclosure.

The first antenna electrode 11 having an annular shape is disposed on the first antenna layer 21 in the antenna 4. Additionally, the second antenna electrode 12 having an annular shape is disposed on the second antenna layer 22. The second antenna electrode 12 may be larger in size from the first antenna electrode 11 and disposed outside the first antenna electrode 11 when seen in plan view along the stacking direction.

Also in the antenna 4, the third antenna electrode 13 having an annular shape is disposed on the third antenna layer 23. Additionally, the fourth antenna electrode 14 having an annular shape is disposed on the fourth antenna layer 24. The fourth antenna electrode 14 may be larger in size than the third antenna electrode 13 and disposed outside the third antenna electrode 13 when seen in plan view along the stacking direction.

The first antenna electrode 11 to the fourth antenna electrode 14 include the largest antenna electrode having an outer periphery and disposed most outside among the first to the fourth antenna electrodes, and the remaining antenna electrodes other than the largest antenna electrode among the first to the fourth antenna electrodes are disposed inward from the outer periphery of the largest antenna electrode when seen in plan view along the stacking direction.

In the antenna 4, the fourth antenna electrode 14 may be the largest antenna electrode, the second antenna electrode 12 may be the second largest antenna electrode, and the third antenna electrode 13 may be the third largest antenna electrode, and the first antenna electrode 11 may be the smallest antenna electrode, for example.

In the antenna 4, the first through-conductor 41A of the first power-feed connector 41 may extend through the ground layer 70 and the bottom surface 61 to the first probe electrode 31 of the dielectric 60. The first antenna electrode 11 to the fourth antenna electrode 14 may be electrically powered via the first power-feed connector 41 and the first probe electrode 31.

In the antenna 4, the first probe electrode 31 may be disposed directly adjacent to the first antenna layer 21 and the second antenna layer 22 in the stacking direction. The first probe electrode 31 overlaps the first antenna electrode 11 that is disposed on the first antenna layer 21 and the second antenna electrode 12 that is disposed on the second antenna layer 22 when seen in plan view along the stacking direction. This configuration allows the pair of the first antenna electrode 11 and the third antenna electrode 13 and the pair of the second antenna electrode 12 and the fourth antenna electrode 14 to be electrically powered via the first power-feed connector 41 and the first probe electrode 31.

In the antenna 4, the first probe electrode 31 may be disposed directly adjacent to one or both of the first antenna electrode 11 and the third antenna electrode 13 and one or both of the second antenna electrode 12 and the fourth antenna electrode 14, for example. In the present embodiment, the first probe electrode 31 may be disposed directly adjacent to the first antenna electrode 11 and the second antenna electrode 12. The third antenna electrode 13 may be coupled to the first antenna electrode 11 that is adjacent to the first probe electrode 31 in the stacking direction in the antenna 4. This configuration allows the third antenna electrode 13 to also be electrically powered via the first antenna electrode 11 despite that the third antenna electrode 13 is not adjacent to the first probe electrode 31 in the stacking direction. Likewise, the fourth antenna electrode 14 may be coupled to the second antenna electrode 12 that is adjacent to the first probe electrode 31 in the stacking direction. This configuration allows the fourth antenna electrode 14 to also be electrically powered via the second antenna electrode 12 despite that the fourth antenna electrode 14 is not adjacent to the first probe electrode 31 in the stacking direction.

When the first antenna electrode 11 to the fourth antenna electrode 14 are electrically powered via the first probe electrode 31 in the antenna 4, an electric current may flow in each of the antenna electrodes to cause each of the antenna electrodes to occur specific resonance based on the current path. The second antenna electrode 12 and the fourth antenna electrode 14 that are coupled and paired to each other may thus serve as an antenna operating in a frequency band centered on a first frequency fa. Additionally, the first antenna electrode 11 and the third antenna electrode 13 that are coupled and paired to each other may serve as an antenna operating in a frequency band centered on a second frequency fb.

In the antenna 4, the first antenna electrode 11 and the third antenna electrode 13 may each have a round-trip length smaller than those of the second antenna electrode 12 and the fourth antenna electrode 14, and the second frequency fb may be higher than the first frequency fa (fb>fa), as in the antenna 1 according to the first embodiment.

In the antenna 4, a specific resonance frequency f1 of the first antenna electrode 11, a specific resonance frequency f2 of the second antenna electrode 12, a specific resonance frequency f3 of the third antenna electrode 13, and a specific resonance frequency f4 of the fourth antenna electrode 14 may satisfy, for example, all of Expressions (1) to (8) described above, as in the antenna 1 according to the first embodiment. This makes it possible to widen the bandwidth in each operation mode.

Example dimensions and other parameters of portions of the antenna 4 illustrated in FIGS. 39 to 42 are as follows:

Wx=8.0, Wy=8.0, a=b=1.42, c=d=1.80, e=f=1.52, g=h=2.00, $w_1$=0.23, $w_3$=0.30, $w_4$=0.32, $w_5$=0.40, $P_w$=0.30, $P_s$=0.20, $P_1$=0.98, D=0.15, $t_1$=0.3, $t_2$=0.4, $t_3$=0.1, $t_4$=0.3, $t_5$=0.2, εr=2.9 where "εr" denotes a relative dielectric constant of the dielectric 60, and the reference characters other than "εr" denote respective dimensions in unit of millimeter [mm].

In the antenna 4, the round-trip lengths L1 to L4 and the specific resonance frequencies f1 to f4 of the first antenna electrode 11 to the fourth antenna electrode 14 are as follows:

L1=4.76 mm, f1=39.1 GHz
L2=6.00 mm, f2=31.2 GHz
L3=4.80 mm, f3=38.6 GHz
L4=6.40 mm, f4=29.6 GHz where each of the round-trip lengths L1 to L4 of the first antenna electrode 11 to the fourth antenna electrode 14 corresponds to a round-trip length along the widthwise center of the corresponding antenna electrode.

Other configurations and operations of the antenna 4 may be substantially similar to those of the antenna 1 according to the first embodiment.

[Antenna Characteristics]

Described below are results of a simulation of various antenna characteristics of the antenna 4. In the simulation, dimensions and other parameters of portions illustrated in FIGS. 39 to 42 were as describe above. Additionally, the round-trip length L1 to L4 and the specific resonance frequencies f1 to f4 of the first antenna electrode 11 to the fourth antenna electrode 14 were as described above.

Figure 43:
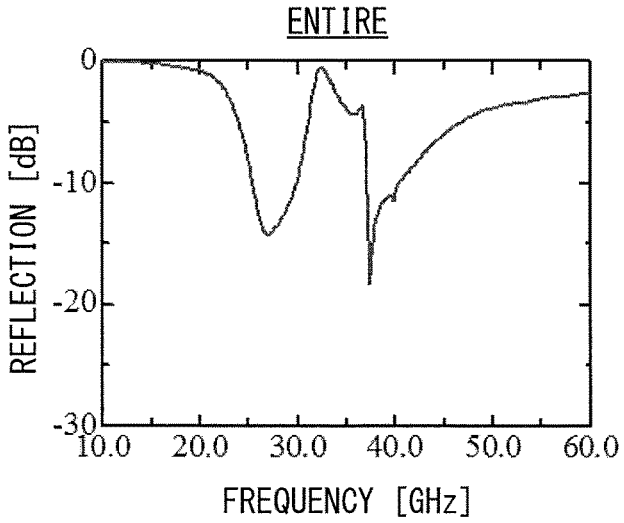
FIG. 43 is a diagram illustrating the entire reflectance of the antenna according to one embodiment.
Figure 44:
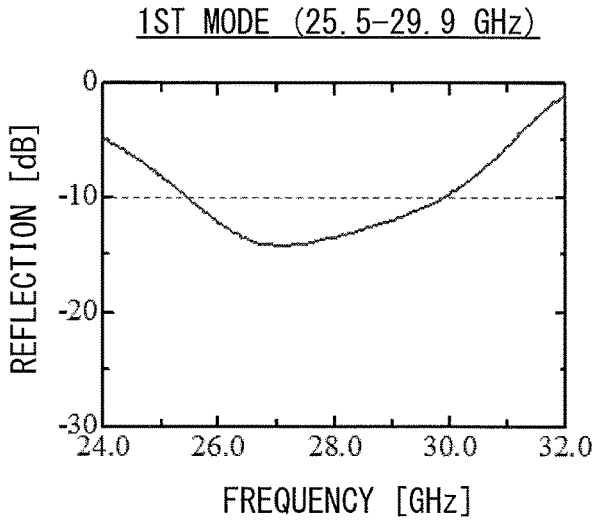
FIG. 44 is an enlarged diagram illustrating a reflectance in a first mode of the antenna according to one embodiment.
Figure 45:
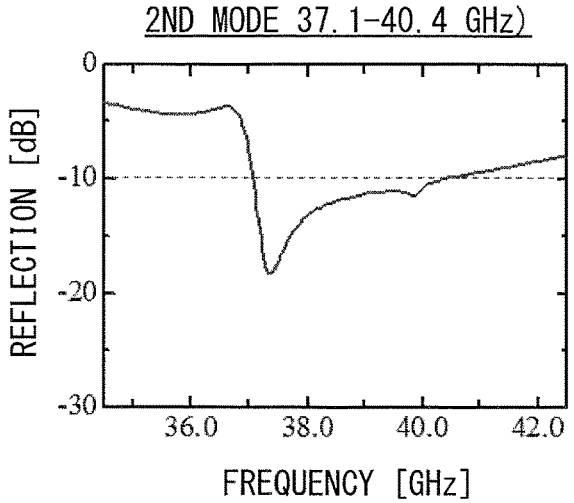
FIG. 45 is an enlarged diagram illustrating a reflectance in a second mode of the antenna according to one embodiment.

FIG. 43 illustrates the result of a simulation of the entire reflectance of the antenna 4. FIG. 44 illustrates the reflectance of the antenna 4 in the first mode in an enlarged manner. FIG. 45 illustrates the reflectance of the antenna 4 in the second mode in an enlarged manner.

FIGS. 43 to 45 demonstrate that a broad frequency band was achieved in each operation mode.

4.2 Modification Example of Fourth Embodiment

Two pairs of the antenna electrodes may be provided in the antenna 4. However, the number of the pairs of the antenna electrodes is not limited to two. In a modification example of the fourth embodiment, the fifth antenna electrode 15 and the sixth antenna electrode 16 may be respectively added to any two of the first to fourth antenna layers 21 to 24, and three or more pairs of the antenna electrodes may be formed to generate three or more frequency bands, as in the antenna 2 according to the second embodiment illustrated in FIGS. 25 to 27. Optionally, two or more additional antenna electrodes may be further added, and four or more pairs of the antenna electrodes may be formed to generate four or more frequency bands.

In the antenna 4 illustrated in FIGS. 39 to 42, the probe layer 51 may be provided between the second antenna layer 22 and the third antenna layer 23. Alternatively, the probe layer 51 may be provided between the third antenna layer 23 and the fourth antenna layer 24.

In another modification example of the fourth embodiment, the antenna 4 may further include the second probe electrode 32, as in the first modification example of the first embodiment illustrated in FIGS. 10 to 13. Alternatively, the antenna 4 may further include the second probe electrode 32 that is excited differentially with the first probe electrode 31, as in the third modification example of the first embodiment illustrated in FIG. 16. Optionally, the antenna 4 may further include the third probe electrode 33 and the fourth probe electrode 34 that are excited differentially with each other, as in the modification example of the first embodiment illustrated in FIGS. 20 to 23 and FIG. 24, for example. Additionally, each of the probe electrodes may have an asymmetric shape, such as an L-shape, when seen in plan view along the stacking direction. Like the first probe electrode 31, the second probe electrode 32 to the fourth probe electrode 34 may be disposed directly adjacent to one or both of the first antenna electrode 11 and the third antenna electrode 13, and one or both of the second antenna electrode 12 and the fourth antenna electrode 14, for example.

5. OTHER EMBODIMENTS

It should be understood by those skilled in the art that various modifications, combinations, sub-combinations and alterations may occur depending on design requirements and other factors insofar as they are within the scope of the appended claims or the equivalents thereof.

For example, the antenna according to any of the foregoing embodiments may be disposed together with other circuitry on a single substrate to form a module.

The foregoing embodiments and modification examples may be applied in any combination. It should be appreciated that the effects described herein are mere examples. Effects of an embodiment of the disclosure are not limited to those described herein. The disclosure may further include any effect other than those described herein.

It is possible to achieve at least the following configurations from the above-described example embodiments and modification examples of the disclosure.

(1) An antenna including:

a dielectric having a first plane, a second plane, a third plane, a fourth plane, and a fifth plane that are stacked parallel to each other in a stacking direction, the third plane being different from the first plane, the fourth plane being different from the second plane, the fifth plane being different from the first to the fourth planes;

a first antenna electrode having an annular shape and disposed on the first plane;

a second antenna electrode having an annular shape and disposed on the second plane, the second antenna electrode being different in size from the first antenna electrode;

a third antenna electrode having an annular shape and disposed on the third plane;

a fourth antenna electrode having an annular shape and disposed on the fourth plane, the fourth antenna electrode being different in size from the third antenna electrode; and at least one probe electrode disposed on the fifth plane and overlapping one or both of the first antenna electrode and the third antenna electrode and one or both of the second antenna electrode and the fourth antenna electrode when seen in plan view along the stacking direction, the first to the fourth antenna electrodes being configured to be electrically powered via the at least one probe electrode, the first to the fourth antenna electrodes including a largest antenna electrode having an outer periphery and disposed most outside among the first to the fourth antenna electrodes, the remaining antenna electrodes other than the largest antenna electrode among the first to the fourth antenna electrodes being disposed inward from the outer periphery of the largest antenna electrode when seen in the plan view along the stacking direction.

(2) The antenna according to (1), in which the first plane and the second plane form a first single face, the third plane and the fourth plane form a second single face, the second antenna electrode is disposed on the first single face and outside the first antenna electrode, and the fourth antenna electrode is disposed on the second single face and outside the third antenna electrode.

(3) The antenna according to (1), in which the first plane and the second plane form an identical face, and the second antenna electrode is disposed on the identical face and outside the first antenna electrode.

(4) The antenna according to (1), in which the first to the fourth planes are different from each other.

(5) The antenna according to any one of (1) to (4), in which the at least one probe electrode includes a first probe electrode and a second probe electrode, the first to the fourth antenna electrodes are mirror symmetric about a first symmetry plane perpendicular to the first to the fourth planes, and the first probe electrode and the second probe electrode are mirror symmetric about the first symmetry plane and excited differentially with each other.

(6) The antenna according to (5), in which the at least one probe electrode further includes a third probe electrode and a fourth probe electrode, the first to the fourth antenna electrodes are mirror symmetric about a second symmetry plane, the second symmetry plane being different from the first symmetry plane and being perpendicular to the first to the fourth planes, and the third probe electrode and the fourth probe electrode are mirror symmetric about the second symmetry plane and excited differentially with each other.

(7) The antenna according to any one of (1) to (4), in which the at least one probe electrode includes a first probe electrode and a second probe electrode, the first to the fourth antenna electrodes have rotational symmetry of 180 degrees about a rotation axis perpendicular to the first to the fourth planes, and the first probe electrode and the second probe electrode have rotational symmetry of 180 degrees about the rotation axis and are excited differentially with each other.

According to the antenna according to at least one of the foregoing embodiments of the disclosure, the first to the fourth antenna electrodes each having an annular shape and the at least one probe electrode are stacked in an appropriate fashion. Accordingly, it is possible to widen respective bandwidths of multiple frequency bands.

Although the disclosure has been described in terms of example embodiments, it is not limited thereto. It should be appreciated that variations may be made in the described embodiments by persons skilled in the art without departing from the scope of the disclosure as defined by the following claims. The limitations in the claims are to be interpreted broadly based on the language employed in the claims and not limited to examples described in this specification or during the prosecution of the application, and the examples are to be construed as non-exclusive. For example, in this disclosure, the use of the terms first, second, etc. do not denote any order or importance, but rather the terms first, second, etc. are used to distinguish one element from another. Moreover, no element or component in this disclosure is intended to be dedicated to the public regardless of whether the element or component is explicitly recited in the following claims.

What is claimed is:

1. An antenna comprising:

a dielectric having a first plane, a second plane, a third plane, a fourth plane, and a fifth plane that are stacked parallel to each other in a stacking direction, the third plane being different from the first plane, the fourth plane being different from the second plane, the fifth plane being different from the first to the fourth planes;

a first antenna electrode having an annular shape and disposed on the first plane;

a second antenna electrode having an annular shape and disposed on the second plane, the second antenna electrode being different in size from the first antenna electrode;

a third antenna electrode having an annular shape and disposed on the third plane;

a fourth antenna electrode having an annular shape and disposed on the fourth plane, the fourth antenna electrode being different in size from the third antenna electrode; and at least one probe electrode disposed on the fifth plane and overlapping one or both of the first antenna electrode and the third antenna electrode and one or both of the second antenna electrode and the fourth antenna electrode when seen in plan view along the stacking direction, the first to the fourth antenna electrodes being configured to be electrically powered via the at least one probe electrode, the first to the fourth antenna electrodes including a largest antenna electrode having an outer periphery and disposed most outside among the first to the fourth antenna electrodes, the remaining antenna electrodes other than the largest antenna electrode among the first to the fourth antenna electrodes being disposed inward from the outer periphery of the largest antenna electrode when seen in the plan view along the stacking direction.

2. The antenna according to claim 1, wherein the first plane and the second plane form a first single face, the third plane and the fourth plane form a second single face, the second antenna electrode is disposed on the first single face and outside the first antenna electrode, and the fourth antenna electrode is disposed on the second single face and outside the third antenna electrode.

3. The antenna according to claim 1, wherein the first plane and the second plane form an identical face, and the second antenna electrode is disposed on the identical face and outside the first antenna electrode.

4. The antenna according to claim 1, wherein the first to the fourth planes are different from each other.

5. The antenna according to claim 1, wherein the at least one probe electrode includes a first probe electrode and a second probe electrode, the first to the fourth antenna electrodes are mirror symmetric about a first symmetry plane perpendicular to the first to the fourth planes, and the first probe electrode and the second probe electrode are mirror symmetric about the first symmetry plane and excited differentially with each other.

6. The antenna according to claim 5, wherein the at least one probe electrode further includes a third probe electrode and a fourth probe electrode, the first to the fourth antenna electrodes are mirror symmetric about a second symmetry plane, the second symmetry plane being different from the first symmetry plane and being perpendicular to the first to the fourth planes, and the third probe electrode and the fourth probe electrode are mirror symmetric about the second symmetry plane and excited differentially with each other.

7. The antenna according to claim 1, wherein the at least one probe electrode includes a first probe electrode and a second probe electrode, the first to the fourth antenna electrodes have rotational symmetry of 180 degrees about a rotation axis perpendicular to the first to the fourth planes, and the first probe electrode and the second probe electrode have rotational symmetry of 180 degrees about the rotation axis and are excited differentially with each other.

* * * * *